US010324397B2

(12) United States Patent
Iwata et al.

(10) Patent No.: US 10,324,397 B2
(45) Date of Patent: Jun. 18, 2019

(54) IMAGE FORMING APPARATUS AND IMAGE FORMING METHOD

(71) Applicants: Muneaki Iwata, Kanagawa (JP); Masaaki Ishida, Kanagawa (JP); Atsufumi Omori, Kanagawa (JP); Hayato Fujita, Kanagawa (JP); Takefumi Takizawa, Kanagawa (JP)

(72) Inventors: Muneaki Iwata, Kanagawa (JP); Masaaki Ishida, Kanagawa (JP); Atsufumi Omori, Kanagawa (JP); Hayato Fujita, Kanagawa (JP); Takefumi Takizawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/203,081

(22) Filed: Jul. 6, 2016

(65) Prior Publication Data

US 2017/0017177 A1 Jan. 19, 2017

(30) Foreign Application Priority Data

Jul. 17, 2015 (JP) ..... 2015-143170

(51) Int. Cl.
*G03G 15/00* (2006.01)
*G03G 15/043* (2006.01)

(52) U.S. Cl.
CPC ..... *G03G 15/043* (2013.01); *G03G 15/5058* (2013.01)

(58) Field of Classification Search
CPC ..... G03G 15/043; G03G 15/5058
(Continued)

(56) References Cited

U.S. PATENT DOCUMENTS

2010/0329712 A1 12/2010 Fukutani et al.
2011/0076040 A1 3/2011 Uchidate et al.
(Continued)

FOREIGN PATENT DOCUMENTS

JP 2004-289368 A 10/2004
JP 2005-070068 3/2005
(Continued)

OTHER PUBLICATIONS

U.S. Appl. No 15/009,990, filed Jan. 29, 2016.
(Continued)

*Primary Examiner* — Walter L Lindsay, Jr.
*Assistant Examiner* — Philipmarcus T Fadul
(74) *Attorney, Agent, or Firm* — Oblon, McClelland, Maier & Neustadt, L.L.P.

(57) ABSTRACT

An image forming apparatus includes a photoconductor drum, a latent-image forming device, a developing device, a density detecting device, and a processing device. The density detecting device is configured to detect densities at a plurality of positions in a main-scanning direction on a developed image. The processing device is configured to acquire at least two light-amount correction tables respectively associated with at least two positions of the plurality of positions in the main-scanning direction on the developed image, the light-amount correction tables being for reducing density variations in a sub-scanning direction at the at least two positions, and correct, for each scan, a set point for setting an amount of light of a light source based on a difference in corresponding correction data between two light-amount correction tables respectively associated with two adjacent positions of the at least two light-amount correction tables.

20 Claims, 22 Drawing Sheets

(58) Field of Classification Search
USPC ..... 399/49
See application file for complete search history.

(56) References Cited

U.S. PATENT DOCUMENTS

| | | | | |
|---|---|---|---|---|
| 2011/0222870 | A1* | 9/2011 | Miyagi | G03G 15/5041 399/15 |
| 2011/0228355 | A1* | 9/2011 | Morita | G03G 15/043 358/475 |
| 2012/0099165 | A1 | 4/2012 | Omori et al. | |
| 2012/0189328 | A1* | 7/2012 | Suzuki | G03G 15/0189 399/32 |
| 2012/0288291 | A1 | 11/2012 | Miyadera | |
| 2013/0272728 | A1 | 10/2013 | Fukutani et al. | |
| 2013/0302052 | A1* | 11/2013 | Iwata | G03G 13/04 399/49 |
| 2014/0268186 | A1 | 9/2014 | Iwata et al. | |
| 2015/0261162 | A1 | 9/2015 | Kaneko et al. | |
| 2015/0324671 | A1 | 11/2015 | Iwata et al. | |

FOREIGN PATENT DOCUMENTS

| | | |
|---|---|---|
| JP | 2011-197446 A | 10/2011 |
| JP | 2012-155042 | 8/2012 |
| JP | 2012-237900 | 12/2012 |
| JP | 2013-235167 | 11/2013 |
| JP | 2014-164202 A | 9/2014 |

OTHER PUBLICATIONS

U.S. Appl. No. 15/067,660, filed Mar. 11, 2016.
Extended European Search Report dated Dec. 20, 2016 in Patent Application No. 16178477.2
Japanese Office Action dated Nov. 7, 2018 for Application No. 2015-143170 (no English translation), 4 pages.

* cited by examiner

Change light amount in sub-scanning direction by changing initial dac value in main-scanning direction with reference to correction values of first light-amount correction table

IMAGE FORMING APPARATUS AND IMAGE FORMING METHOD

CROSS-REFERENCE TO RELATED APPLICATION

The present application claims priority under 35 U.S.C. § 119 to Japanese Patent Application No. 2015-143170, filed Jul. 17, 2015. The contents of which are incorporated herein by reference in their entirety.

BACKGROUND OF THE INVENTION

1. Field of the Invention

The present invention relates generally to image forming apparatuses and image forming methods, and in particular, relates to an image forming apparatus and an image forming method for forming an image by scanning a surface of a photoconductor drum.

2. Description of the Related Art

In recent years, image forming apparatuses that form an image by scanning a surface of a photoconductor drum are being actively developed.

For example, an image forming apparatus configured to reduce two-dimensional density nonuniformity (i.e., density nonuniformity in the sub-scanning direction and density nonuniformity in the main-scanning direction; hereinafter, "two-dimensional density nonuniformity in the sub-scanning direction and in the main-scanning direction") in an image is disclosed in Japanese Unexamined Patent Publication No. 2005-070068.

However, the image forming apparatus disclosed in Japanese Unexamined Patent Publication No. 2005-070068 is susceptible to improvement in reduction of two-dimensional density nonuniformity in the sub-scanning direction and in the main-scanning direction in an image with less decrease in productivity.

SUMMARY OF THE INVENTION

According to one aspect of the present invention, an image forming apparatus includes a photoconductor drum, a latent-image forming device, a developing device, a density detecting device, and a processing device. The latent-image forming device includes a light source and configured to scan a surface of the photoconductor drum with light from the light source in a main-scanning direction to form a latent image on the surface. The developing device is configured to develop the latent image into a developed image. The density detecting device is configured to detect densities at a plurality of positions in the main-scanning direction on the developed image. The processing device is configured to acquire at least two light-amount correction tables respectively associated with at least two positions of the plurality of positions in the main-scanning direction on the developed image, the light-amount correction tables being for reducing density variations in a sub-scanning direction at the at least two positions, and correct, for each scan, a set point for setting an amount of light of the light source based on a difference in corresponding correction data between two light-amount correction tables respectively associated with two adjacent positions of the at least two light-amount correction tables.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DETAILED DESCRIPTION OF THE PREFERRED EMBODIMENTS

Figure 1:
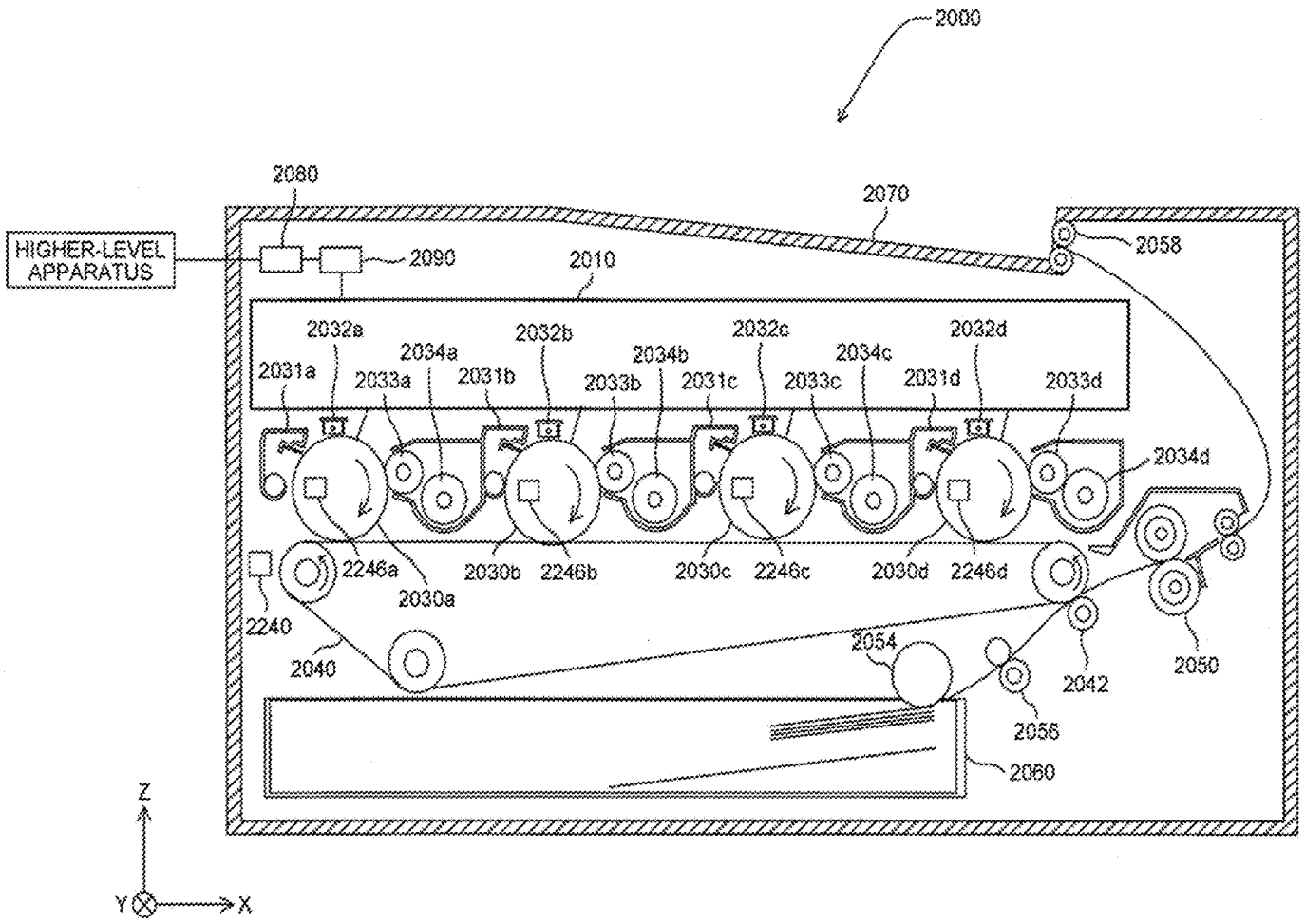
FIG. 1 is a diagram illustrating a schematic configuration of a color printer according to an embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment of the present invention is described below with reference to FIG. 1 to FIG. 20. FIG. 1 illustrates a schematic configuration of a color printer 2000 as an image forming apparatus according to the embodiment.

The color printer 2000 is a multiple-color printer of a tandem system configured to form a full-color image by superimposing four colors (black, cyan, magenta, and yellow) on one another. The color printer 2000 includes an optical scanning device 2010, four photoconductor drums (2030*a*, 2030*b*, 2030*c*, and 2030*d*), four cleaning units (2031*a*, 2031*b*, 2031*c*, and 2031*d*), four charging devices (2032*a*, 2032*b*, 2032*c*, and 2032*d*), four developing rollers (2033*a*, 2033*b*, 2033*c*, and 2033*d*), four toner cartridges (2034*a*, 2034*b*, 2034*c*, and 2034*d*), a transfer belt 2040, a transfer roller 2042, a fixing roller 2050, a paper feeding roller 2054, a pair of registration rollers 2056, a paper ejection roller 2058, a paper feeding tray 2060, a paper ejection tray 2070, a communication control device 2080, a density detector 2240, four home position sensors (2246*a*, 2246*b*, 2246*c*, and 2246*d*), four potential sensors (not illustrated), and a printer control device 2090 that performs centralized control of these elements. Hereinafter, the four photoconductor drums (2030*a*, 2030*b*, 2030*c*, and 2030*d*) are collectively referred to as "the photoconductor drums 2030" when no differentiation is necessary. The four developing rollers (2033*a*, 2033*b*, 2033*c*, and 2033*d*) are collectively referred to as "the developing rollers 2033" when no differentiation is necessary.

The communication control device 2080 controls mutual communications to and from a higher-level apparatus (e.g., a personal computer) over a network or the like.

The printer control device 2090 includes a CPU, a ROM, a RAM (random access memory), and an A/D conversion circuit. A software program written in code native to the CPU and a variety of data for use in executing the software program is stored in the ROM. The RAM is a work memory. The A/D conversion circuit converts analog data to digital data. The printer control device 2090 controls these elements in accordance with requests received from the higher-level apparatus and transmits image data (image information) received from the higher-level apparatus to the optical scanning device 2010.

The photoconductor drum 2030*a*, the charging device 2032*a*, the developing roller 2033*a*, the toner cartridge 2034*a*, and the cleaning unit 2031*a* are used as a set making up an image forming station (hereinafter, sometimes referred to as "K station" for convenience's sake) for forming black images.

The photoconductor drum 2030*b*, the charging device 2032*b*, the developing roller 2033*b*, the toner cartridge 2034*b*, and the cleaning unit 2031*b* are used as a set making up an image forming station (hereinafter, sometimes referred to as "C station" for convenience's sake) for forming cyan images.

The photoconductor drum 2030*c*, the charging device 2032*c*, the developing roller 2033*c*, the toner cartridge 2034*c*, and the cleaning unit 2031*c* are used as a set making up an image forming station (hereinafter, sometimes referred to as "M station" for convenience's sake) for forming magenta images.

The photoconductor drum 2030*d*, the charging device 2032*d*, the developing roller 2033*d*, the toner cartridge 2034*d*, and the cleaning unit 2031*d* are used as a set making up an image forming station (hereinafter, sometimes referred to as "Y station" for convenience's sake) for forming yellow images.

Hereinafter, the image forming station is sometimes simply referred to as "the station".

A photosensitive layer is formed on the surface of each of the photoconductor drums. Put another way, the surface of each of the photoconductor drums is a surface to be scanned. It is assumed that each of the photoconductor drums is rotated by a rotating mechanism (not illustrated) in the direction indicated by an arrow in the paper plane of FIG. 1.

In the following description, it is assumed that, in the XYZ three-dimensional Cartesian coordinate system, the longitudinal direction of each of the photoconductor drums lies along the Y-axis direction; the direction, along which the four photoconductor drums are aligned, is the X-axis direction.

Each of the charging devices uniformly charges the surface of the corresponding photoconductor drum.

The optical scanning device 2010 irradiates, in accordance with multiple-color image information (black image information, cyan image information, magenta image information, and yellow image information) received from the higher-level apparatus, the charged surface of each of the photoconductor drums with a corresponding one of beams that are modulated on a per-color basis. As a result, charges on the surfaces of the photoconductor drums dissipate only at portions irradiated with light, and latent images are formed on the surfaces of the photoconductor drums in accordance with the image information. As the photoconductor drum rotates, the thus-formed latent image is moved toward the corresponding developing roller. A configuration of the optical scanning device 2010 will be described below.

On each of the photoconductor drums, an area where image information is to be written is referred to as "effective scanning area", "image forming area", "effective image area" or the like.

The toner cartridge 2034*a* stores therein black toner, which is to be supplied to the developing roller 2033*a*. The toner cartridge 2034*b* stores therein cyan toner, which is to be supplied to the developing roller 2033*b*. The toner cartridge 2034*c* stores therein magenta toner, which is to be supplied to the developing roller 2033*c*. The toner cartridge 2034*d* stores therein yellow toner, which is to be supplied to the developing roller 2033*d*.

As each of the developing rollers rotates, a uniform thin coating of toner supplied from the corresponding toner cartridge is applied to the surface of the developing roller. When the toner on the surface of each of the developing rollers comes into contact with the surface of the corresponding photoconductor drum, the toner transfers only to the portions irradiated with light on the surface and sticks to the portions. Put another way, each of the developing rollers causes the toner to stick to the latent image formed on the surface of the corresponding photoconductor drum, thereby developing the latent image into a visible image. The image (toner image), to which the toner is sticking, is moved toward the transfer belt 2040 as the photoconductor drum rotates.

The toner images of yellow, magenta, cyan, and black are sequentially transferred with predetermined timing onto the transfer belt 2040 to be superimposed on one another to form a full-color image.

Recording paper is stored in the paper feeding tray 2060. The paper feeding roller 2054 is arranged near the paper feeding tray 2060. The paper feeding roller 2054 picks up the recording paper one sheet by one sheet from the paper feeding tray 2060 and conveys the recording paper to the pair of registration rollers 2056. The pair of registration rollers 2056 delivers the recording paper to a gap between the transfer belt 2040 and the transfer roller 2042 with given timing. At the gap, the full-color image on the transfer belt 2040 is transferred onto the recording paper. The recording paper, onto which the image has been transferred, is delivered to the fixing roller 2050.

The fixing roller 2050 applies, to the recording paper, heat and a pressure, whereby toner is fixed onto the recording paper. The recording paper, to which the toner has been fixed, is delivered by the paper ejection roller 2058 onto the paper ejection tray. The recording paper is sequentially stacked in a pile on the paper ejection tray 2070.

Each of the cleaning units removes toner (residual toner) left on the surface of the corresponding photoconductor drum. The surface of the photoconductor drum, from which the residual toner has been removed, returns to a position where the surface faces the corresponding charging device.

Figure 2:
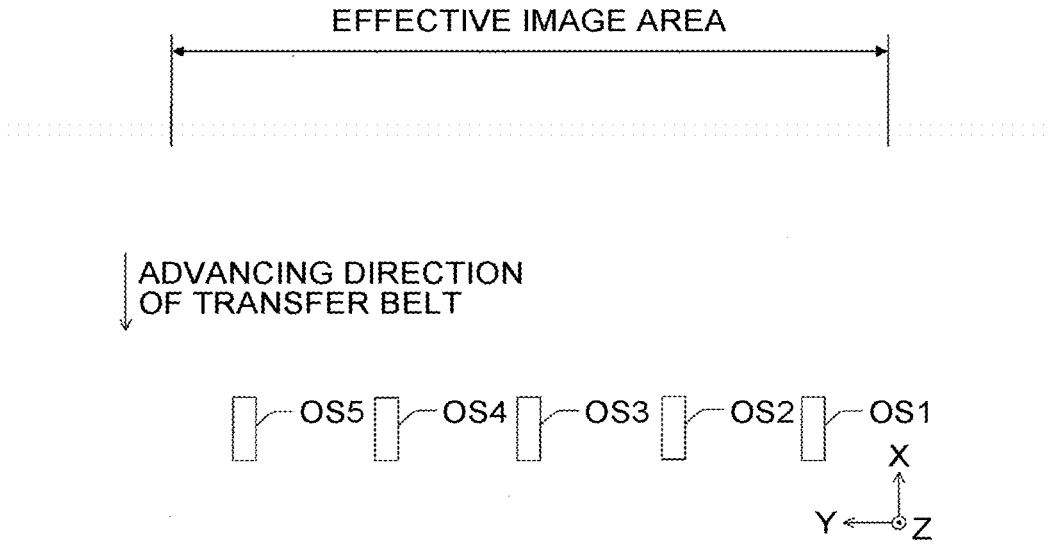
FIG. 2 is a diagram for describing a density detector.

The density detector 2240 is arranged on the negative X side of the transfer belt 2040. The density detector 2240 includes, for example, as illustrated in FIG. 2, the five optical sensors (OS1 to OS5).

The five optical sensors (OS1 to OS5) are substantially equidistantly arranged along the Y-axis direction and facing an effective image area of the transfer belt 2040. Specifically, the optical sensor OS1 is arranged at an outermost position on the negative Y side; the optical sensor OS5 is arranged at an outermost position on the positive Y side; the optical sensors OS2 to OS4 are arranged in this order between the two optical sensors (OS1 and OS5) from the negative Y side to the positive Y side.

Figure 3:
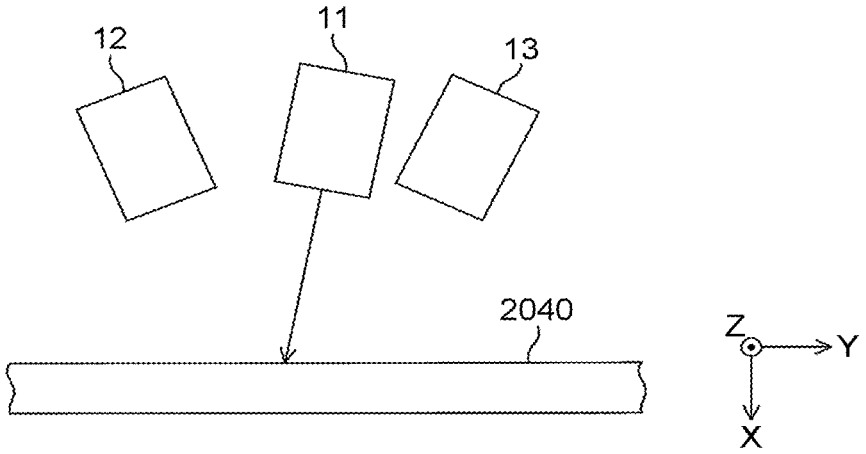
FIG. 3 is a diagram for describing an optical sensor.
Figure 4:
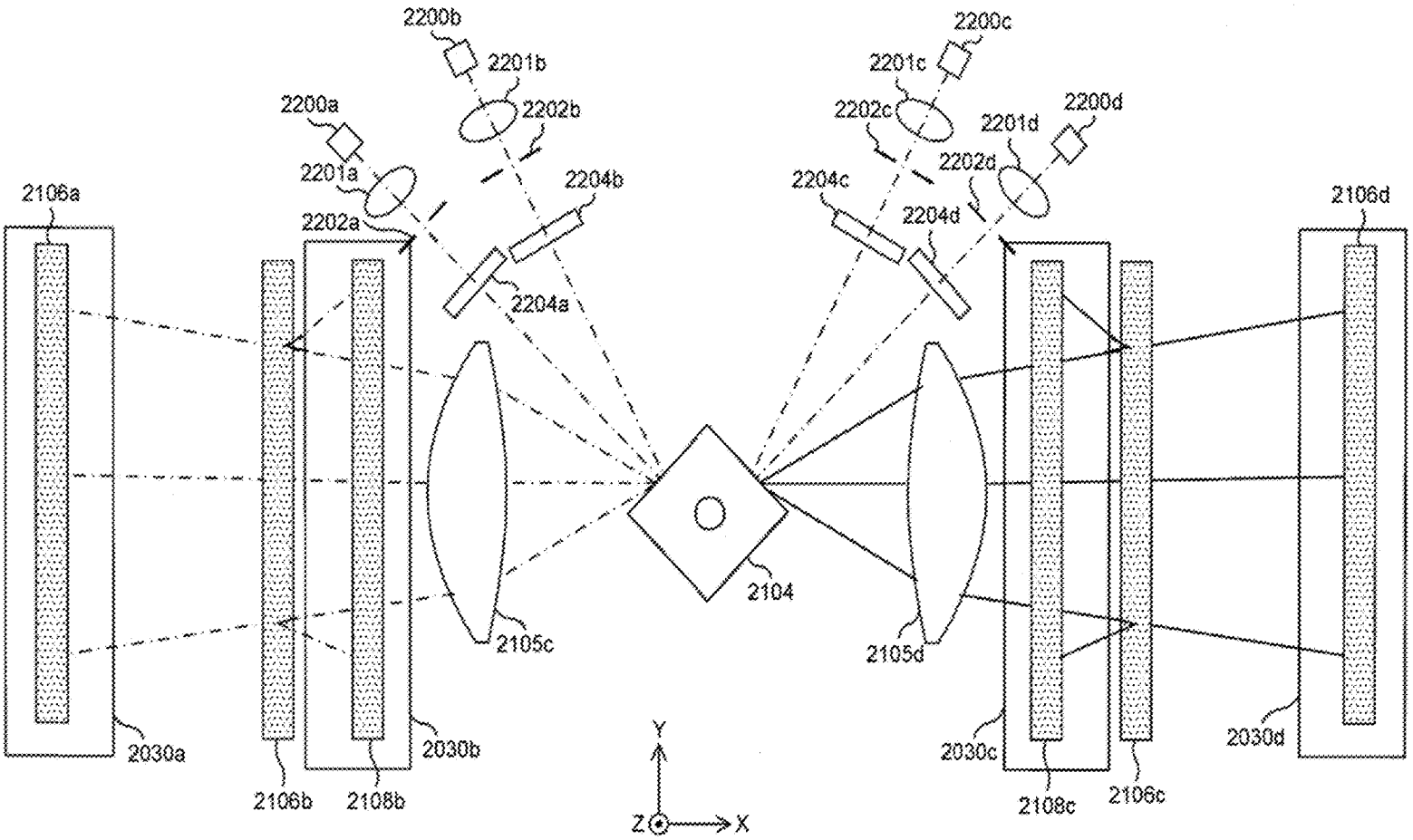
FIG. 4 is a first diagram for describing an optical scanning device.
Figure 5:
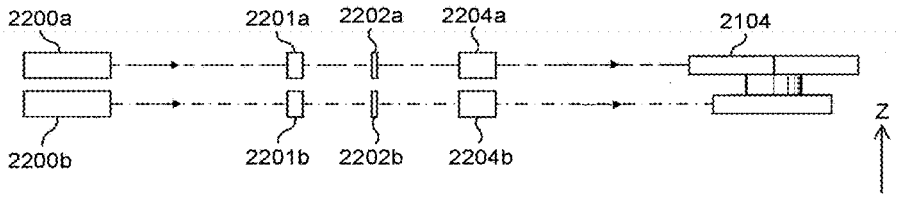
FIG. 5 is a second diagram for describing the optical scanning device.
Figure 6:
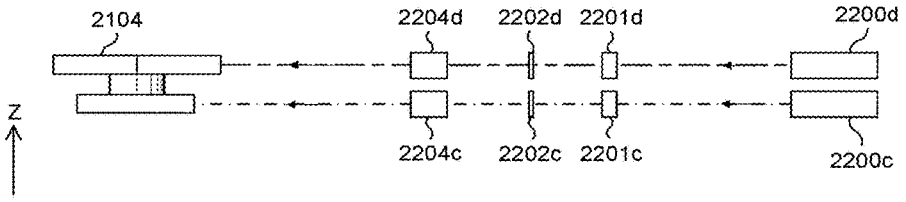
FIG. 6 is a third diagram for describing the optical scanning device.
Figure 7:
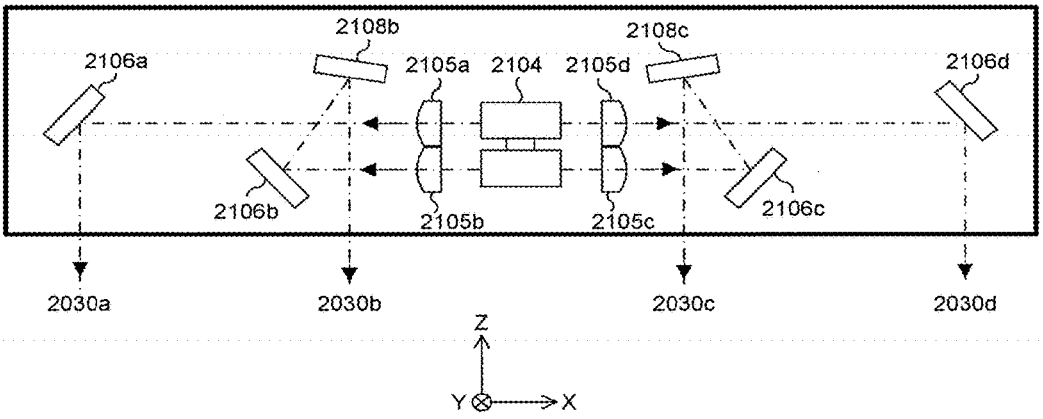
FIG. 7 is a fourth diagram for describing the optical scanning device.

As illustrated in FIG. 3, for example, each of the optical sensors includes an LED 11, a specularly-reflected-light receiving element 12, and a diffuse-reflected-light receiving element 13. The LED 11 emits light (hereinafter, sometimes referred to as "detection light") toward the transfer belt 2040. The specularly-reflected-light receiving element 12 receives specularly-reflected light from the transfer belt 2040 or a toner pad on the transfer belt 2040. The diffuse-reflected-light receiving element 13 receives diffuse-reflected light from the transfer belt 2040 or the toner pad on the transfer belt 2040. Each of the light receiving elements outputs a signal (photoelectric conversion signal) responsive to an amount of received light.

The home position sensor 2246*a* detects a rotational home position of the photoconductor drum 2030*a*.

The home position sensor 2246*b* detects a rotational home position of the photoconductor drum 2030*b*.

The home position sensor 2246*c* detects a rotational home position of the photoconductor drum 2030*c*.

The home position sensor 2246*d* detects a rotational home position of the photoconductor drum 2030*d*.

The four potential sensors are arranged to individually face the four photoconductor drums 2030. Each of the potential sensors detects surface potential information of the photoconductor drum 2030 facing the potential sensor.

A configuration of the optical scanning device 2010 is described below.

Figure 8:
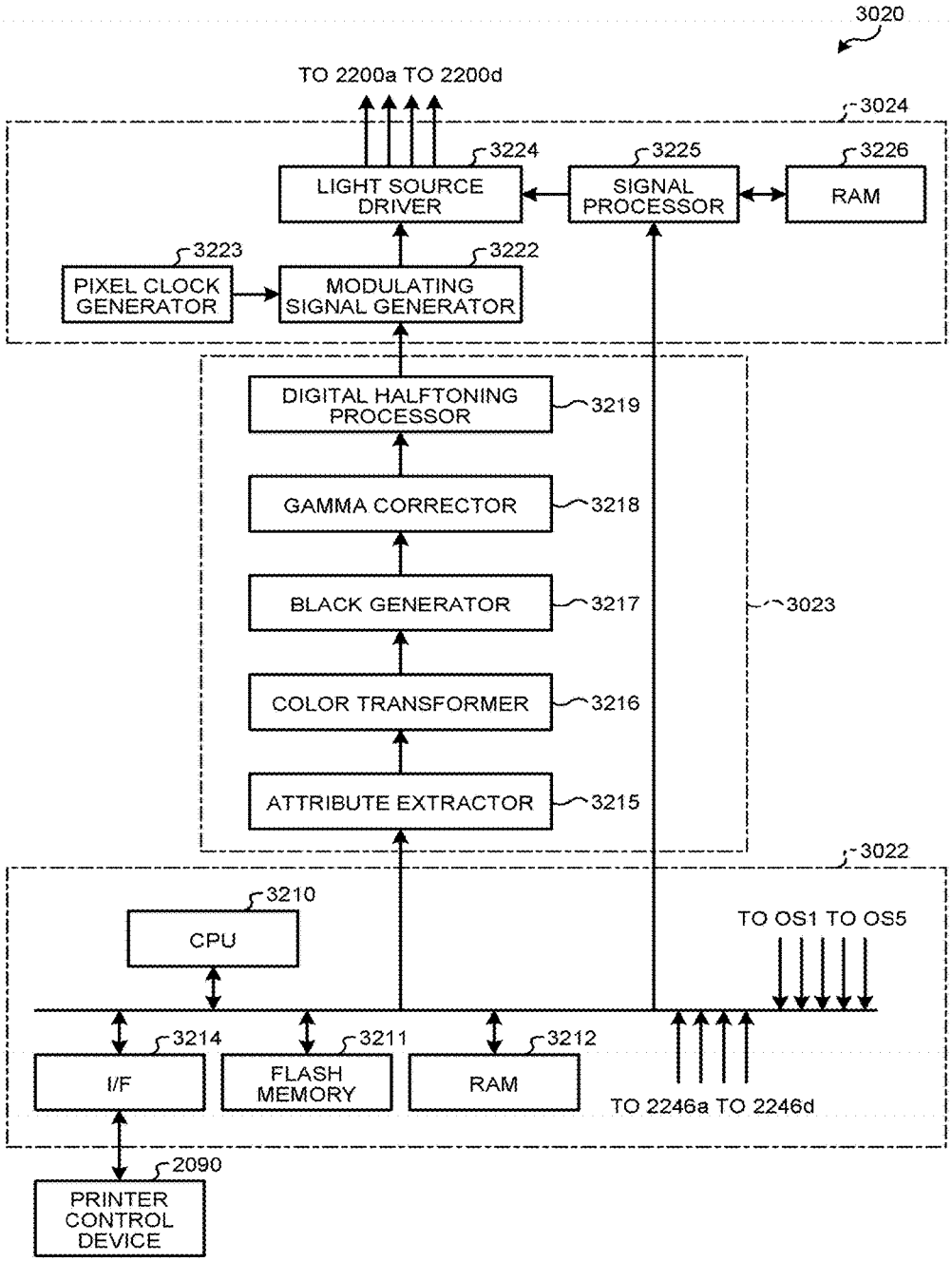
FIG. 8 is a diagram for describing a scan control device.

The optical scanning device 2010 includes, for example, as illustrated in FIG. 4 to FIG. 8, a latent-image forming device (optical scanning system) and a scan control device 3020 (not illustrated in FIG. 4 to FIG. 7; see FIG. 8). The latent-image forming device includes four light sources (2200*a*, 2200*b*, 2200*c*, and 2200*d*), four coupling lenses (2201*a*, 2201*b*, 2201*c*, and 2201*d*), four aperture plates (2202*a*, 2202*b*, 2202*c*, and 2202*d*), four cylindrical lenses (2204*a*, 2204*b*, 2204*c*, and 2204*d*), a polygon mirror 2104, four scanning lenses (2105*a*, 2105*b*, 2105*c*, and 2105*d*), and six redirecting mirrors (2106*a*, 2106*b*, 2106*c*, 2106*d*, 2108*b*, and 2108*c*). These elements are assembled to predetermined positions in an optical housing (not illustrated). Hereinafter, the four light sources (2200*a*, 2200*b*, 2200*c*, and 2200*d*) are collectively referred to as "the light sources 2200" when no differentiation is necessary.

Each of the light sources includes a surface-emitting laser array, in which a plurality of (e.g., 40) light-emitting elements are arranged in a two-dimensional array. The plurality of light-emitting elements of the surface-emitting laser array are arranged such that, for example, when all the light-emitting elements are orthogonally projected onto an imaginary line extending in a direction corresponding to the sub-scanning direction, intervals between the light-emitting elements are equal on the line. Put another way, the plurality of light-emitting elements are spaced from each other in at least the direction corresponding to the sub-scanning direction. In the present specification, the term "interval between the light-emitting elements" denotes a center-to-center distance between two adjacent light-emitting elements.

The coupling lens 2201*a* is arranged on an optical path of a beam emitted from the light source 2200*a* to convert the beam into a substantially parallel beam.

The coupling lens 2201*b* is arranged on an optical path of a beam emitted from the light source 2200*b* to convert the beam into a substantially parallel beam.

The coupling lens 2201*c* is arranged on an optical path of a beam emitted from the light source 2200*c* to convert the beam into a substantially parallel beam.

The coupling lens 2201*d* is arranged on an optical path of a beam emitted from the light source 2200*d* to convert the beam into a substantially parallel beam.

The aperture plate 2202*a* has an aperture and shapes the beam passed through the coupling lens 2201*a*.

The aperture plate 2202*b* has an aperture and shapes the beam passed through the coupling lens 2201*b*.

The aperture plate 2202*c* has an aperture and shapes the beam passed through the coupling lens 2201*c*.

The aperture plate 2202*d* has an aperture and shapes the beam passed through the coupling lens 2201*d*.

The cylindrical lens 2204*a* focuses, in the Z-axis direction, the beam passed through the aperture of the aperture plate 2202*a* to form an image near a deflecting reflection facet of the polygon mirror 2104.

The cylindrical lens 2204*b* focuses, in the Z-axis direction, the beam passed through the aperture of the aperture plate 2202*b* to form an image near the deflecting reflection facet of the polygon mirror 2104.

The cylindrical lens 2204*c* focuses, in the Z-axis direction, the beam passed through the aperture of the aperture plate 2202*c* to form an image near a deflecting reflection facet of the polygon mirror 2104.

The cylindrical lens 2204*d* focuses, in the Z-axis direction, the beam passed through the aperture of the aperture plate 2202*d* to form an image near the deflecting reflection facet of the polygon mirror 2104.

An optical system made up of the coupling lens 2201*a*, the aperture plate 2202*a*, and the cylindrical lens 2204*a* is a pre-deflector optical system for the K station.

An optical system made up of the coupling lens 2201*b*, the aperture plate 2202*b*, and the cylindrical lens 2204*b* is a pre-deflector optical system for the C station.

An optical system made up of the coupling lens 2201*c*, the aperture plate 2202*c*, and the cylindrical lens 2204*c* is a pre-deflector optical system for the M station.

An optical system made up of the coupling lens 2201*d*, the aperture plate 2202*d*, and the cylindrical lens 2204*d* is a pre-deflector optical system for the Y station.

The polygon mirror 2104 has two four-faceted mirrors, which are stacked in two layers, rotating about an axis parallel to the Z-axis. Each facet serves as the deflecting reflection facet. The four-faceted mirror on the first layer (lower layer) is arranged so as to deflect the beam from the cylindrical lens 2204*b* and the beam from the cylindrical lens 2204*c*. The four-faceted mirror on the second layer (upper layer) is arranged so as to deflect the beam from the cylindrical lens 2204*a* and the beam from the cylindrical lens 2204*d*.

The beam from the cylindrical lens 2204*a* and the beam from the cylindrical lens 2204*b* are deflected to the negative X side of the polygon mirror 2104. The beam from the cylindrical lens 2204*c* and the beam from the cylindrical lens 2204*d* are deflected to the positive X side of the polygon mirror 2104.

Each of the scanning lenses has an optical power that focuses a beam to near the corresponding photoconductor drum and an optical power that causes, as the polygon mirror 2104 rotates, a light spot to move on the surface of the corresponding photoconductor drum in the main-scanning direction at a constant velocity.

The scanning lens 2105*a* and the scanning lens 2105*b* are arranged on the negative X side of the polygon mirror 2104. The scanning lens 2105*c* and the scanning lens 2105*d* are arranged on the positive X side of the polygon mirror 2104.

The scanning lens 2105*a* and the scanning lens 2105*b* are stacked on one another in the Z-axis direction. The scanning lens 2105*b* faces the four-faceted mirror on the first layer, while the scanning lens 2105*a* faces the four-faceted mirror on the second layer. The scanning lens 2105*c* and the scanning lens 2105*d* are stacked on one another in the Z-axis direction. The scanning lens 2105*c* faces the four-faceted mirror on the first layer, while the scanning lens 2105*d* faces the four-faceted mirror on the second layer.

The beam exiting the cylindrical lens 2204*a* is deflected by the polygon mirror 2104 and irradiates, via the scanning lens 2105*a* and the redirecting mirror 2106*a*, the photoconductor drum 2030*a* to form a light spot thereon. The light spot moves in the longitudinal direction of the photoconductor drum 2030*a* as the polygon mirror 2104 rotates. In other words, the light spot scans the surface of the photoconductor drum 2030*a*. The direction, in which the light spot moves, is the "main-scanning direction" of the photoconductor drum 2030*a*; the rotating direction of the photoconductor drum 2030*a* is the "sub-scanning direction" of the photoconductor drum 2030*a*.

The beam exiting the cylindrical lens 2204*b* is deflected by the polygon mirror 2104 and irradiates, via the scanning lens 2105*b*, the redirecting mirror 2106*b*, and the redirecting mirror 2108*b*, the photoconductor drum 2030*b* to form a light spot thereon. The light spot moves in the longitudinal direction of the photoconductor drum 2030*b* as the polygon mirror 2104 rotates. In other words, the light spot scans the surface of the photoconductor drum 2030*b*. The direction, in which the light spot moves, is the "main-scanning direction" of the photoconductor drum 2030*b*; the rotating direction of the photoconductor drum 2030*b* is the "sub-scanning direction" of the photoconductor drum 2030*b*.

The beam exiting the cylindrical lens 2204*c* is deflected by the polygon mirror 2104 and irradiates, via the scanning lens 2105*c*, the redirecting mirror 2106*c*, and the redirecting mirror 2108*c*, the photoconductor drum 2030*c* to form a light spot thereon. The light spot moves in the longitudinal direction of the photoconductor drum 2030*c* as the polygon mirror 2104 rotates. In other words, the light spot scans the surface of the photoconductor drum 2030*c*. The direction, in which the light spot moves, is the "main-scanning direction" of the photoconductor drum 2030*c*; the rotating direction of the photoconductor drum 2030*c* is the "sub-scanning direction" of the photoconductor drum 2030*c*.

The beam exiting the cylindrical lens 2204*d* is deflected by the polygon mirror 2104 and irradiates, via the scanning lens 2105*d* and the redirecting mirror 2106*d*, the photoconductor drum 2030*d* to form a light spot thereon. The light spot moves in the longitudinal direction of the photoconductor drum 2030*d* as the polygon mirror 2104 rotates. In other words, the light spot scans the surface of the photoconductor drum 2030*d*. The direction, in which the light spot moves, is the "main-scanning direction" of the photoconductor drum 2030*d*; the rotating direction of the photoconductor drum 2030*d* is the "sub-scanning direction" of the photoconductor drum 2030*d*.

The redirecting mirrors are arranged such that the optical path length from the polygon mirror 2104 to the photoconductor drum is identical among the photoconductor drums and that each of beams is incident at a same position and at a same incidence of angle on the corresponding photoconductor drum.

The optical system arranged on the optical path between the polygon mirror 2104 and each of the photoconductor drums is also referred to as a scanning optical system. The scanning optical system for the K station is made up of the scanning lens 2105*a* and the redirecting mirror 2106*a*. The scanning optical system for the C station is made up of the scanning lens 2105*b* and the two redirecting mirrors (2106*b* and 2108*b*). The scanning optical system for the M station is made up of the scanning lens 2105*c* and the two redirecting mirrors (2106*c* and 2108*c*). The scanning optical system for the Y station is made up of the scanning lens 2105*d* and the redirecting mirror 2106*d*. The scanning lens in each of the scanning optical systems may include a plurality of lenses.

FIG. 8 illustrates a schematic configuration of the scan control device 3020. As illustrated in FIG. 8, the scan control device 3020 includes an interface unit 3022, an image processing unit 3023, and a drive control unit 3024.

The interface unit 3022 transfers RGB image data (input image data) that has been transferred to the interface unit 3022 via the communication control device 2080 and the printer control device 2090 from the higher-level apparatus (e.g., a personal computer) to the image processing unit 3023 downstream.

The image processing unit 3023 functions as an image processor. The image processing unit 3023 acquires the image data from the interface unit 3022 and converts it into color image data appropriate for a printing system to be used. For example, the image processing unit 3023 may convert RGB image data into image data for a tandem system (i.e., CMYK image data). The image processing unit 3023 performs, in addition to data format conversion, a variety of image processing on the image data. The image processing unit 3023 sends the converted image data to the drive control unit 3024.

The drive control unit 3024 modulates the image data received from the image processing unit 3023 into clock signals indicating light emission timing for pixels, thereby generating modulating signals that are independent on a per-color basis. The drive control unit 3024 drives each of the light sources 2200*a*, 2200*b*, 2200*c*, and 2200*d* to cause light emission in accordance with the modulating signal for its corresponding color.

The drive control unit 3024 is, for example, a single, integrated-into-one-chip device arranged near the light sources 2200*a*, 2200*b*, 2200*c*, and 2200*d*. Accordingly, the drive control unit 3024 can be mounted and removed easily and therefore is advantageous in ease of maintenance and replacement. The image processing unit 3023 and the interface unit 3022 are arranged farther from the light sources 2200*a*, 2200*b*, 2200*c*, and 2200*d* than the drive control unit 3024 is. A cable (not illustrated) connects between the image processing unit 3023 and the drive control unit 3024.

The optical scanning device 2010 configured as described above can cause each of the light sources to emit light in accordance image data, thereby forming latent images on the surfaces of the corresponding photoconductor drums.

Detailed description of the units of the scan control device 3020 is provided below.

The interface unit 3022 includes, for example, a flash memory 3211, a RAM 3212, an I/F 3214, and a CPU 3210. The flash memory 3211, the RAM 3212, the I/F 3214, and the CPU 3210 are connected to each other via a bus.

The flash memory 3211 stores a software program to be executed by the CPU 3210 and a variety of data necessary for execution of the software program by the CPU 3210. The RAM 3212 is a work area for use in execution of the software program by the CPU 3210. The I/F 3214 performs mutual communications with the printer control device 2090.

The CPU 3210 operates in accordance with the software program stored in the flash memory 3211 to perform overall control of the optical scanning device 2010.

The interface unit 3022 configured as described above receives input image data (which is 8-bit RGB data having a resolution N) from the printer control device 2090 and passes it to the image processing unit 3023.

The image processing unit 3023 includes an attribute extractor 3215, a color transformer 3216, a black generator 3217, a gamma corrector 3218, and a digital halftoning processor 3219.

The attribute extractor 3215 receives the input image data (8-bit RGB data having the resolution N) from the interface unit 3022. Attribute information (attribute data) is added to each pixel of the input image data. The attribute information indicates a type of a source object of a corresponding area (i.e., the pixel). For instance, if the pixel is a part of a text, an attribute indicating "text" is indicated by the attribute information. For instance, if the pixel is a part of a line, an attribute indicating "line" is indicated by the attribute information. If the pixel is a part of a graphical shape, an attribute indicating "graphical shape" is indicated by the attribute information. If the pixel is a part of a photograph, an attribute indicating "photograph" is indicated by the attribute information.

The attribute extractor 3215 separates the attribute information and image data from the input image data. The attribute extractor 3215 sends the image data (8-bit RGB data having the resolution N) to the color transformer 3216.

The color transformer 3216 converts the RGB image data received from the attribute extractor 3215 into CMY image data and sends it to the black generator 3217.

The black generator 3217 generates CMYK image data by generating a black component from the CMY image data received from the color transformer 3216 and sends the CMYK image data to the gamma corrector 3218.

The gamma corrector 3218 linearly transforms levels of the respective colors of the CMYK image data received from the black generator 3217 using a table or the like and sends the transformed image data to the digital halftoning processor 3219.

The digital halftoning processor 3219 reduces the number of gray levels of the CMYK image data received from the gamma corrector 3218 and outputs 1-bit image data. Specifically, the digital halftoning processor 3219 performs digital halftoning, such as dithering and error diffusion, thereby reducing the number of gray levels of the 8-bit image data to 1 bit. As a result, periodic screens (e.g., dot screens and line screens), i.e., screens making up a pattern, picture, and the like, are formed in the image data. The digital halftoning processor 3219 transmits the 1-bit CMYK image data having the resolution N to the drive control unit 3024.

All or a part of the image processing unit 3023 may be implemented in hardware or, alternatively, implemented by execution of a software program by the CPU 3210.

The drive control unit 3024 includes a pixel clock generator 3223, a modulating signal generator 3222, a light source driver 3224, a signal processor 3225, and a RAM 3226.

The pixel clock generator 3223 generates a pixel clock signal indicating light emission timing for pixels.

The modulating signal generator 3222 generates, from the image data received from the image processing unit 3023, modulating signals (light-emission timing signals) that are independent on a per-color basis and in synchronization with the pixel clock signal and sends the modulating signals to the light source driver 3224.

The signal processor 3225 generates current references (DAC values) for the light sources 2200 from values stored in a register and values in light-amount correction tables, which will be described below, stored in the RAM 3226 and sends the DAC values to the light source driver 3224.

The light source driver 3224 drives each of the light sources 2200 in accordance with a corresponding one of the modulating signals, which are independent on a per-color basis, received from the modulating signal generator 3222 and a corresponding one of the DAC values received from the signal processor 3225. Hence, the light source driver 3224 can cause each of the light sources 2200 to emit light in a pattern in accordance with the corresponding modulating signal and of an amount in accordance with the corresponding DAC value.

The optical scanning device 2010 configured as described above can cause each of the light sources 2200 to emit light in accordance image data, thereby forming latent images on the surfaces of the photoconductor drums corresponding to the light sources.

When the photoconductor drum is off-centered or is an imperfect circle in cross section, a gap between the photoconductor drum and the developing roller varies periodically as the photoconductor drum rotates. This variation in the gap causes the developing process to fluctuate and results in periodic density variation (density nonuniformity) in the sub-scanning direction in an output image (image that is eventually formed). Not only the photoconductor drums but also other rotating members, such as the developing roller and the charging roller, of an image formation engine cause similar density variation. Image forming apparatuses configured to periodically modulate a developing bias, a charging bias, or an amount of light, thereby correcting such density variation are already known.

Figure 25:
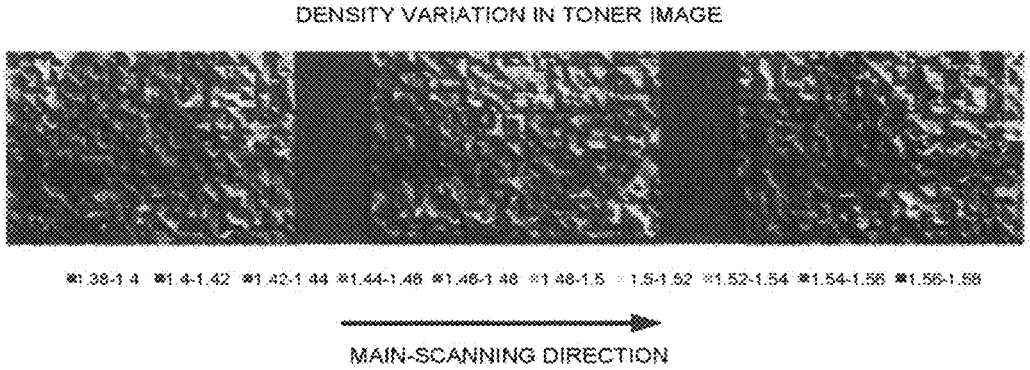
FIG. 25 is a diagram illustrating a specific example of density variations in a toner image.

However, such a conventional image forming apparatus configured to correct periodic density variation in the sub-scanning direction corrects the density variation only by modulating image formation conditions (the amount of light to be emitted from a light source, the developing bias, and the charging bias) uniformly in the sub-scanning direction. The shape (circularity) of the rotating member, such as the photoconductor drum, can have a deviation in the main-scanning direction; furthermore, density variation is susceptible to nonuniform charging. Accordingly, actual density variation appearing in a toner image is not uniform in the sub-scanning direction (see FIG. 25). As illustrated in FIG. 25, an output image has two-dimensional density nonuniformity in the sub-scanning direction and in the main-scanning direction.

For this reason, the attempt of correcting the density variation in the sub-scanning direction by uniformly modulating the image formation conditions can arise a problem that, contrarily to the attempt, density variation is produced by over-correction.

Calculating two-dimensional correction values in the sub-scanning direction and the main-scanning direction to correct the two-dimensional density variations requires complicated computations and storing a large volume of data in a memory and, accordingly, requires considerably long computing time and transfer time. This undesirably leads to considerable decreases in productivity.

Under the circumstances, the inventors have developed a technique for reducing two-dimensional density nonuniformity that can appear in an output image with less decrease in productivity, and applied the technique to the image forming method of the present embodiment as described below.

In the image forming method of the present embodiment, a process (light-amount-correction-table acquisition process) of acquiring a plurality of (e.g., three) light-amount correction tables for respectively reducing density variation in the sub-scanning direction at a plurality of positions (e.g., three positions) in the main-scanning direction is performed first.

The light-amount-correction-table acquisition process of the present embodiment is described below with reference to FIG. 9. The flowchart of FIG. 9 corresponds to a processing algorithm to be executed by the signal processor 3225. This light-amount-correction-table acquisition process may be performed at regular intervals (e.g., at time intervals of between 8 and 24 hours) for each of the stations. The K station is representatively described below.

In advance, shading correction in the main-scanning direction or, specifically, correcting deviation in the main-scanning direction that comes from the optical system of the optical scanning device 2010, is performed by canceling out effects of transmittance and the like of the optical system to make an amount of light incident on an image surface uniform; and main-scanning-direction shading values (hereinafter, sometimes simply referred to as "the shading values") are acquired and set to the register. The DAC value, which is the current reference that determines the amount of light, is changed (increased or decreased) according to the thus-set main-scanning-direction shading values. The DAC value is changed when a main-scanning shading flag is set (see FIG. 18).

At S1, which is the first step, five density-variation measurement patterns (P1 to P5) are formed on the transfer belt 2040. Hereinafter, the five density-variation measurement patterns (P1 to P5) are respectively abbreviated as "the patterns P1 to P5". Furthermore, the patterns P1 to P5 are collectively referred to as "the patterns" when no differentiation is necessary.

Figure 10:
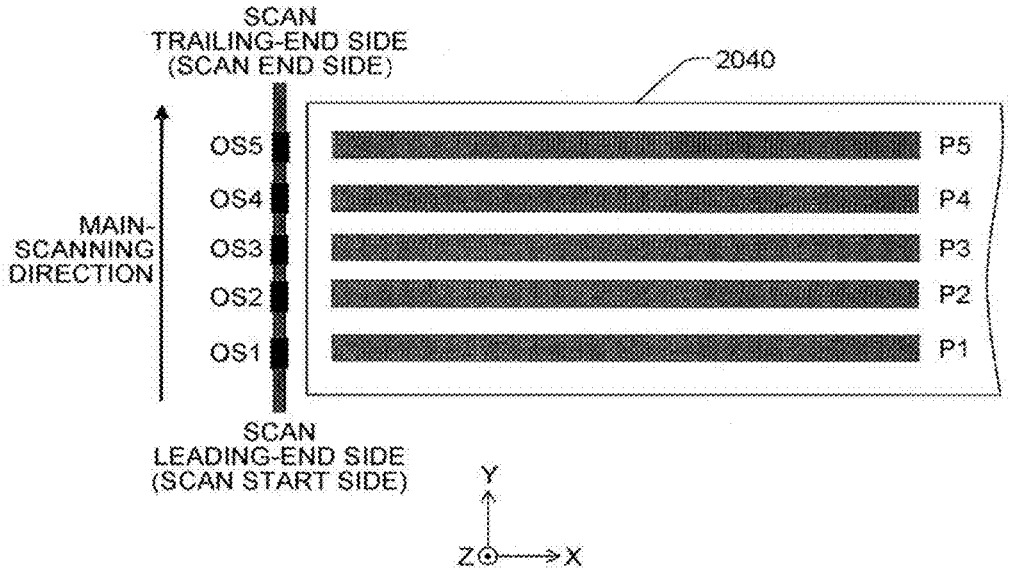
FIG. 10 is a diagram illustrating five optical sensors (OS1 to OS5) and density-variation measurement patterns (P1 to P5)
Figure 11:
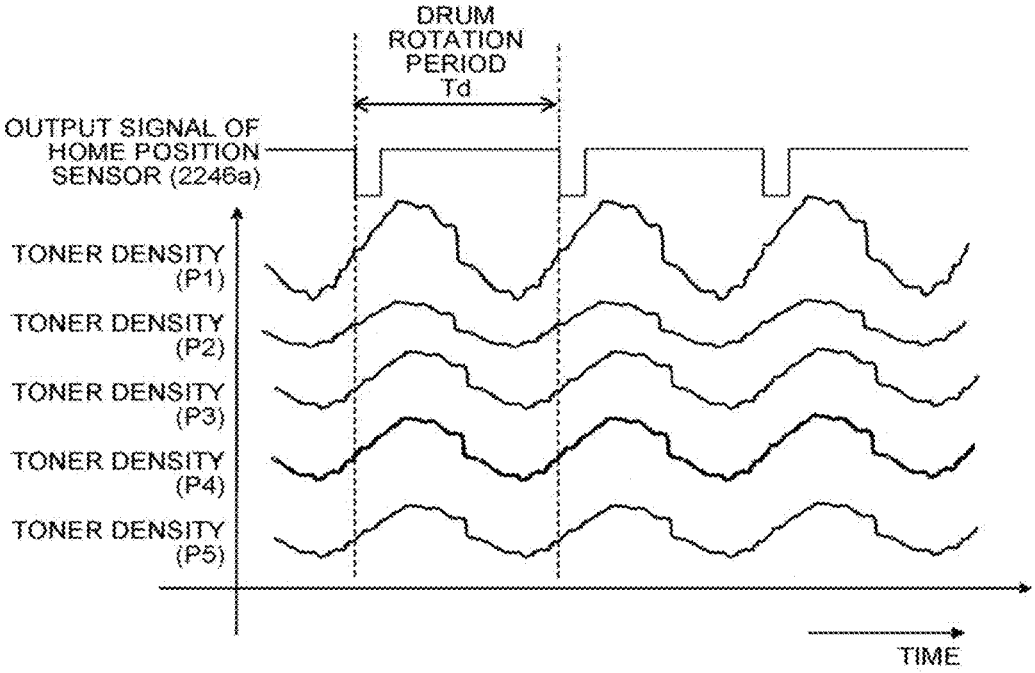
FIG. 11 is a diagram illustrating output signals of the five optical sensors (OS1 to OS5)

Specifically, for each scan, the DAC value (set point) that determines the light amount of the light source 2200 is corrected using the shading values. The light source is driven to scan the surface of the photoconductor drum 2030*a* in accordance with the shading-corrected DAC value (hereinafter, sometimes referred to as "initial DAC value") and the modulating signal. As illustrated in FIG. 10, the five patterns (P1 to P5) corresponding to at least one turn of the photoconductor drum 2030*a* are formed on the transfer belt 2040 at positions respectively corresponding to the five optical sensors (OS1 to OS5).

In this example, the five patterns (P1 to P5), each of which is an elongated toner pattern extending in the X-axis direction (i.e., the sub-scanning direction), are equidistantly arranged along the Y-axis direction (i.e., the main-scanning direction). Specifically, the pattern P1 is positioned at an outermost position on the negative Y side (scan leading-end side); the pattern P5 is positioned at an outermost position on the positive Y side (scan trailing-end side); the patterns P2 to P4 are arranged in this order between the two patterns (P1 and P5) from the negative Y side to the positive Y side.

The LEDs 11 of the optical sensors are lit on. The detection light from each of the LEDs 11 irradiates the corresponding pattern along the direction corresponding to the sub-scanning direction as the transfer belt 2040 rotates (revolves) or, put another way, as time elapses.

At S2, which is the next step, density variations in the sub-scanning direction of the respective patterns are acquired.

Specifically, during when each of the patterns is irradiated with the detection light from the LED 11 of the corresponding optical sensor, output signals of the specularly-reflected-light receiving element 12 and the diffuse-reflected-light receiving element 13 of the optical sensor are acquired at predetermined time intervals. Toner density is calculated from the sensor output signals (see FIG. 11).

By calculating toner densities at the main-scanning five positions (in this example, the five patterns (P1 to P5)) on the transfer belt 2040 respectively corresponding to the five optical sensors (OS1 to OS5) arranged along the main-scanning direction in this manner, both periodic density variation in the sub-scanning direction and density deviation in the main-scanning direction can be acquired. In short, intra-page two-dimensional density-variation information can be acquired.

At S3, which is the next step, density variation in the sub-scanning direction of each of the patterns is approximated by a periodic function.

Figure 12:
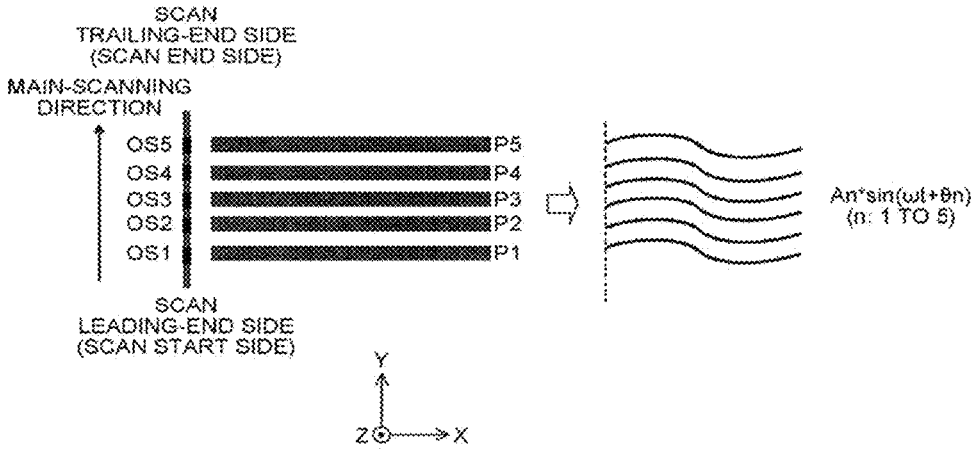
FIG. 12 is a diagram for describing approximation of the output signals of the five optical sensors (OS1 to OS5) by a periodic function.

Specifically, density variation in the sub-scanning direction in each of the patterns is sampled as a periodic function (e.g., as a sine-wave pattern) of the same period as the rotation period (a drum rotation period Td) of the photoconductor drum 2030*a* on the basis of an output signal (hereinafter, sometimes referred to as "HP signal") of the home position sensor 2246*a* (see FIG. 12).

At S4, which is the next step, three light-amount correction tables (each for the rotation period (corresponding to one turn) of the photoconductor drum 2030*a*) are acquired. One of the three light-amount correction tables is associated with density variation having the largest amplitude among the density variations approximated to periodic functions of the patterns P2 to P4. The other two are respectively associated with density variation approximated to a periodic function of the pattern P1 and density variation approximated to a periodic function of the pattern P5. Hereinafter, the light-amount correction table associated with the pattern P1 is referred to as "the first light-amount correction table". The light-amount correction table associated with the pattern exhibiting the density variation having the largest amplitude is referred to as "the second light-amount correction table". The light-amount correction table associated with the pattern P5 is referred to as "the third light-amount correction table".

Specifically, one cycle of each of the sine-wave patterns acquired at S3 is converted to a light-amount correction table (a pattern obtained by shifting the phase of the sine-wave pattern by 180°) corresponding to the rotation period of the photoconductor drum 2030*a*. In other words, each of the light-amount correction tables is created so as to reduce the density variation in the sub-scanning direction pertaining to the photoconductor drum 2030*a*.

Figure 14:
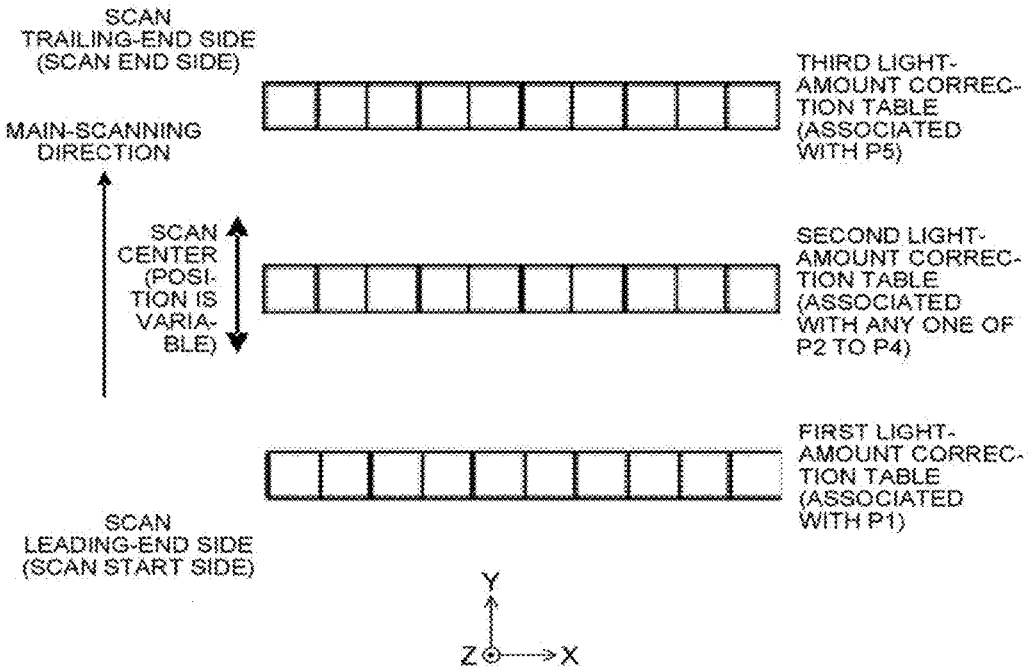
FIG. 14 is a first diagram for describing acquisition of three light-amount correction tables respectively associated with three positions in the main-scanning direction.

The first and third light-amount correction tables are respectively associated with the patterns P1 and P5 and, accordingly, fixed, for example, whereas the second light-amount correction table is associated with any one of the patterns P2 to P4 and, accordingly, variable, for example (see FIG. 14).

Figure 15:
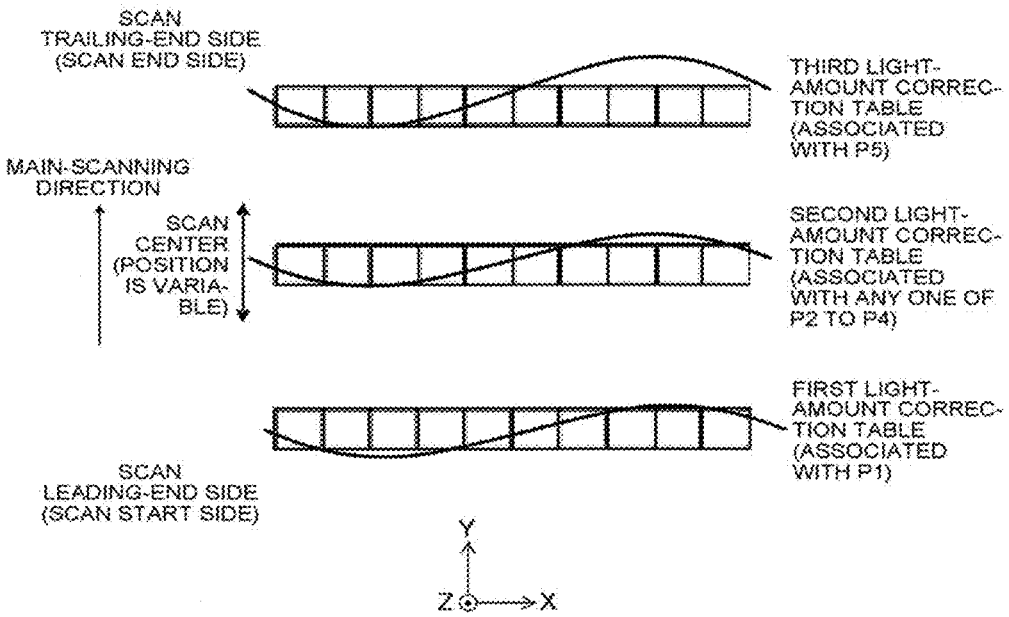
FIG. 15 is a second diagram for describing acquisition of the three light-amount correction tables respectively associated with the three positions in the main-scanning direction.

Specifically, the first and third light-amount correction tables are created so as to reduce density variations at the two positions on the both ends in the main-scanning direction, whereas the second light-amount correction table is created so as to reduce density variation at a position where the need for correction is greatest in between the both ends in the main-scanning direction (see FIG. 15).

At S5, which is the next step, the light-amount correction tables are stored in the RAM 3226.

Figure 13:
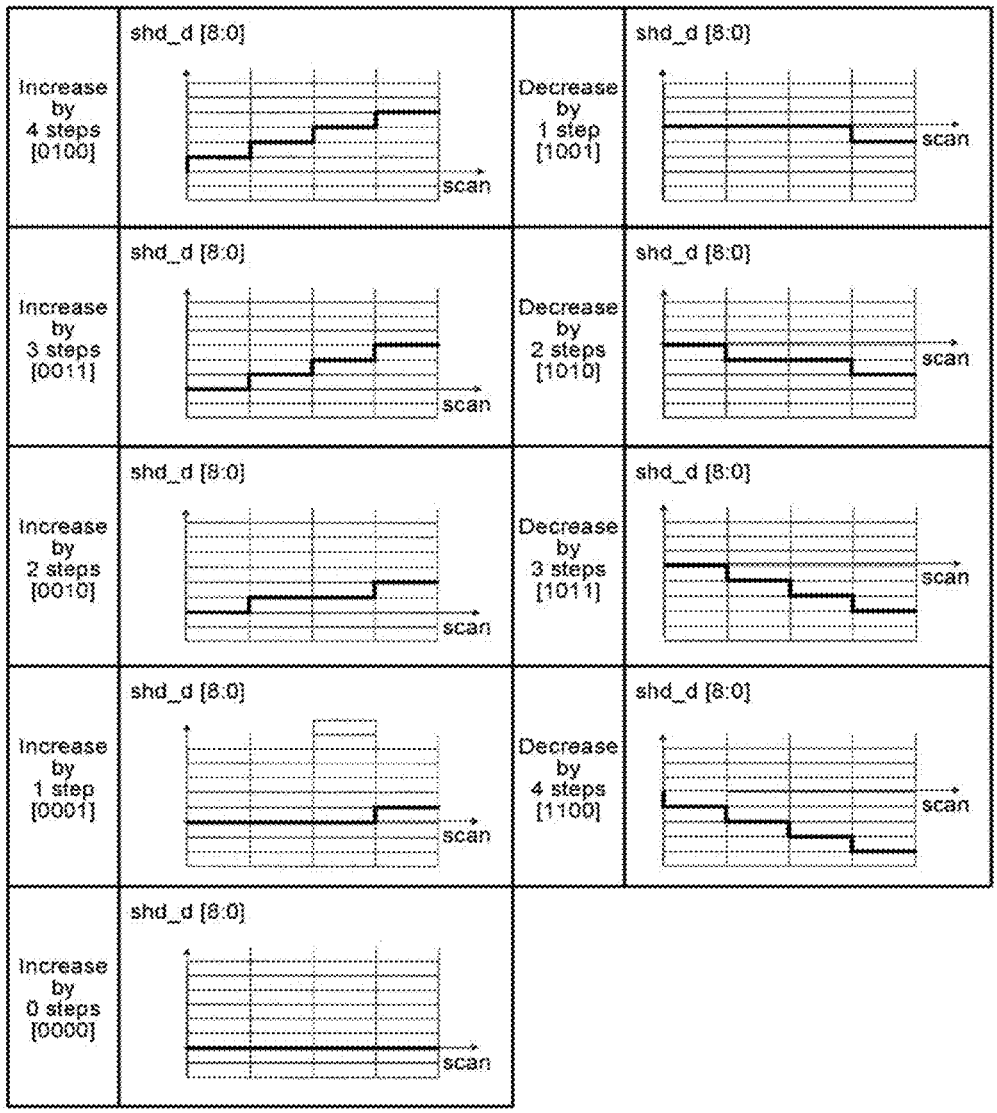
FIG. 13 is a diagram for describing a way of storing light-amount correction tables in a RAM.

Specifically, light-amount correction values are converted to quantized difference values indicating, for example, how many steps are to be modulated from a previous scan as illustrated in FIG. 13, and the difference values are stored in the RAM 3226. This leads to reduction in the amount of data stored in the RAM 3226. The number of steps (hereinafter, "step count") and the size of each step of the light amount modulation depend on, for example, minimum resolution of the light amount modulation. To reduce adverse effect on images, it is basically desirable to limit modulation in one scan only to 0, ±1, or ±2 steps of the minimum resolution. Further reduction in the amount of data to be stored in the RAM 3226 can be obtained by generating and storing light-amount correction values for every plurality of scans (e.g., for every four scans; see FIG. 13) rather than by storing such light-amount correction values as those described above for each scan. The light-amount correction value for every plurality of scans may preferably be split into per-scan light-amount correction values as illustrated in FIG. 13 and applied.

Comparison of a necessary amount of data memory between a scheme of storing light-amount correction values as a two-dimensional matrix and the present embodiment is made below. Correction values to be stored as a two-dimensional matrix for 1,024 scans, each divided by 64 in the main-scanning direction, with a data depth of 8 bits require 64×8×1,024=524,288 (bits) in a straightforward calculation. By contrast, according to the present embodiment, correction values require 64×8 (bits)+1,024/4×3×4 (bits)=3,584 (bits), where 64 is the number into which each scan in the main-scanning direction is divided, 4 is the number of scans every which correction values are to be stored, 3 is the number of positions (scan leading end, scan center, and scan trailing end), and 4 (bits) are for difference values relative to a previous scan (see FIG. 13). Hence, the present embodiment enables considerable reduction in the amount of data memory for storing the correction values.

Furthermore, at S4 described above, intra-page two-dimensional density-variation information can be acquired with a still smaller amount of data memory by virtue of creating the two light-amount correction tables associated with the patterns P1 and P5 on the both ends and the light-amount correction table associated with a pattern having the largest amplitude of density variation among the three patterns (P2 to P4) between the two patterns (P1 and P5).

The pattern, for which the light-amount correction table is to be created, of the three patterns (P2 to P4) is not necessarily the pattern having the largest amplitude of density variation. Light-amount correction tables respectively associated with density variations of two or more patterns of the patterns P2 to P4 may be created. In this case, although the necessary amount of data memory increases, intra-page two-dimensional density-variation information can be acquired with higher accuracy.

Figure 9:
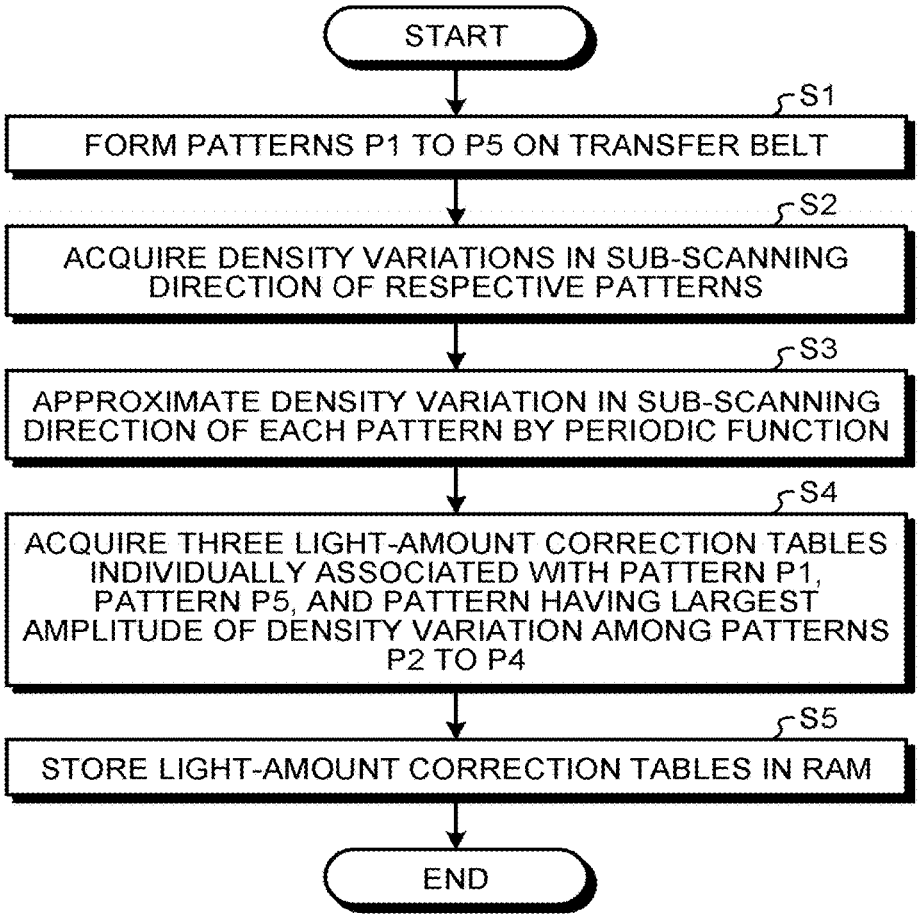
FIG. 9 is a flowchart for describing a light-amount-correction-table acquisition process.

When, after the light-amount-correction-table acquisition process illustrated in the flowchart of FIG. 9 has been performed as described above, image data is fed from the higher-level apparatus to the interface unit 3022 via the communication control device 2080 and the printer control device 2090, the image data undergoes predetermined processing performed by the image processing unit 3023 and thereafter is sent to the drive control unit 3024.

In the drive control unit 3024, the modulating signal generator 3222 generates modulating signals that are independent on a per-color basis in accordance with the pixel clock signal received from the pixel clock generator 3223 and sends the modulating signals to the light source driver 3224.

At this time, the signal processor 3225 reads out the first to third light-amount correction tables from the RAM 3226 for each of the stations, performs a light-amount-correction-data generation process, which will be described below, to generate light-amount correction data, and sends the generated light-amount correction data to the light source driver 3224.

The light source driver 3224 corrects the initial DAC value (shading-corrected DAC value) using corresponding light-amount correction data for each of the colors, and outputs the corrected initial DAC value to the corresponding light source.

Hence, the surface of the rotating corresponding photoconductor drum is scanned in the main-scanning direction with light emitted from the light source driven in accordance with the corresponding modulating signal and the corresponding corrected initial DAC value.

As a result, a toner image that is reduced in two-dimensional density variations in the sub-scanning direction and in the main-scanning direction is formed on the surface of each of the photoconductor drums and, eventually, an image with reduced two-dimensional density nonuniformity is formed on recording paper.

Figure 16:
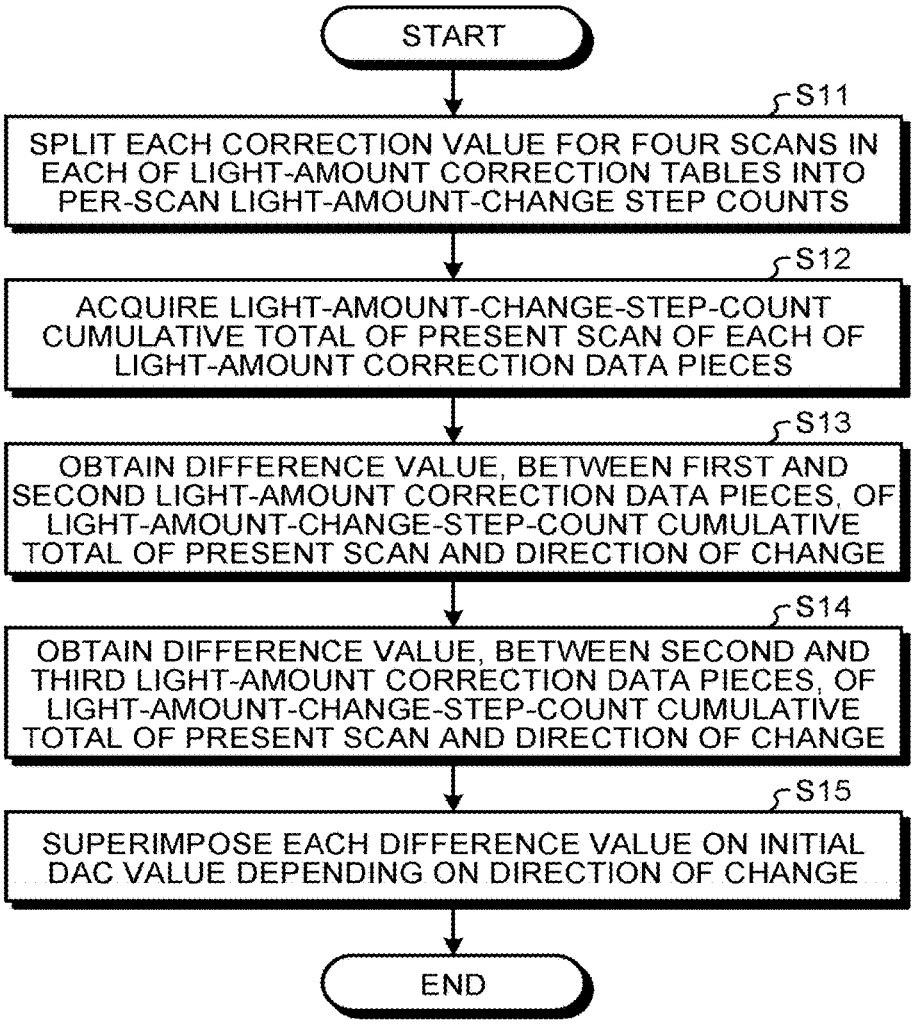
FIG. 16 is a flowchart for describing a light-amount-correction-data generation process.

The light-amount-correction-data generation process is described below with reference to FIG. 16 to FIG. 18. The flowchart of FIG. 16 corresponds to a processing algorithm to be executed by the signal processor 3225. The light-amount-correction-data generation process is performed for each scan in each of the stations. The light-amount-correction-data generation process in the K station is representatively described below. For convenience's sake, only data concerning the first few scans is illustrated in FIG. 17.

At S11, which is the first step, each correction value for four scans in each of the light-amount correction tables is split into per-scan numbers of light-amount-change steps (hereinafter, "per-scan light-amount-change step counts") (correction values) (see FIG. 17). A unit step height of the light-amount-change steps is set to be lower than 1% (in this example, 0.1%) of a lowest value (e.g., 80) of the initial DAC values. Note that FIG. 17 representatively illustrates only the first light-amount correction table and per-scan light-amount-change step counts obtained by splitting correction values of the first light-amount correction table.

Figure 17:
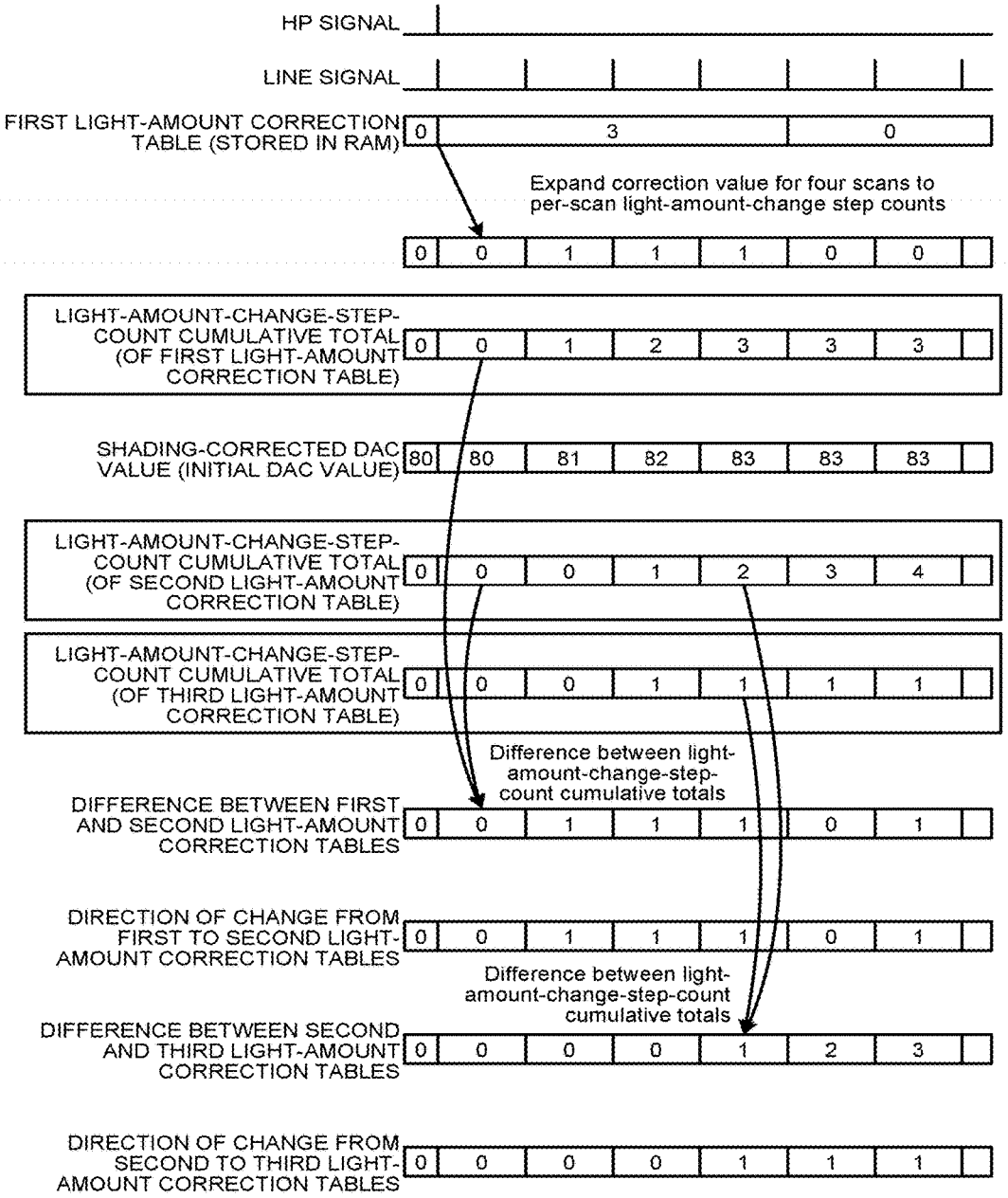
FIG. 17 is a first diagram for describing the light-amount-correction-data generation process.

At S12, which is the next step, a cumulative total of light-amount-change step counts from first scan to the present scan (which can be the first scan) of each of the light-amount correction tables is calculated, and these cumulative totals are acquired as cumulative total values of the present scan (see FIG. 17).

At S13, which is the next step, a difference value, between the first and second light-amount correction tables, of the light-amount-change-step-count cumulative total of the same scan and a direction of change (increasing or decreasing direction) from the side of the first light-amount correction table (upstream in the main-scanning direction) to the side of the second light-amount correction table (downstream in the main-scanning direction) are obtained (see FIG. 17). In this example, as for the direction of change of the difference, 0 represents the increasing direction, while 1 represents the decreasing direction.

At S14, which is the next step, a difference value, between the second and third light-amount correction tables, of the light-amount-change-step-count cumulative total of the same scan and a direction of change (increasing or decreasing direction) from the side of the second light-amount correction table (upstream in the main-scanning direction) to the side of the third light-amount correction table (downstream in the main-scanning direction) are obtained (see FIG. 17). The order of S13 and S14 may be reversed.

The difference values and the directions of change obtained at S13 and S14 make up a correction parameter for correcting deviation in the main-scanning direction of density variations in the sub-scanning direction.

At S15, which is the next step, each of the difference values described above is added to or subtracted from (hereinafter, "superimposed on") an initial DAC value depending on the direction of change (see FIG. 18 and FIG. 19).

Figure 18:
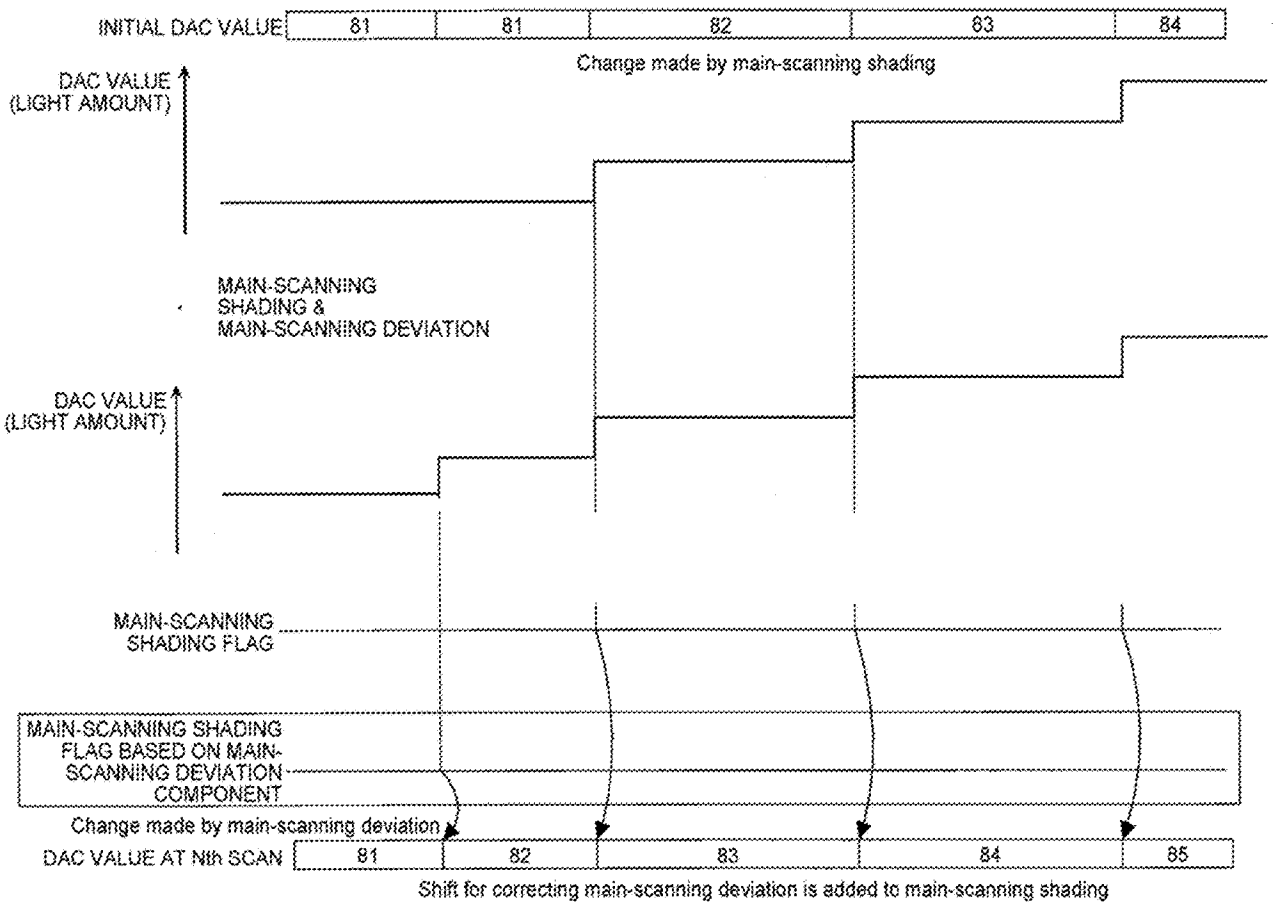
FIG. 18 is a second diagram for describing the light-amount-correction-data generation process.
Figure 19:
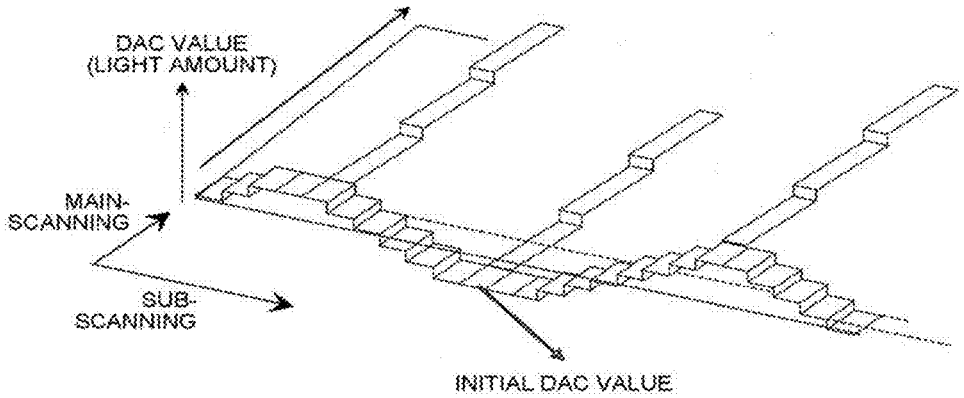
FIG. 19 is a third diagram for describing the light-amount-correction-data generation process.
Figure 19:
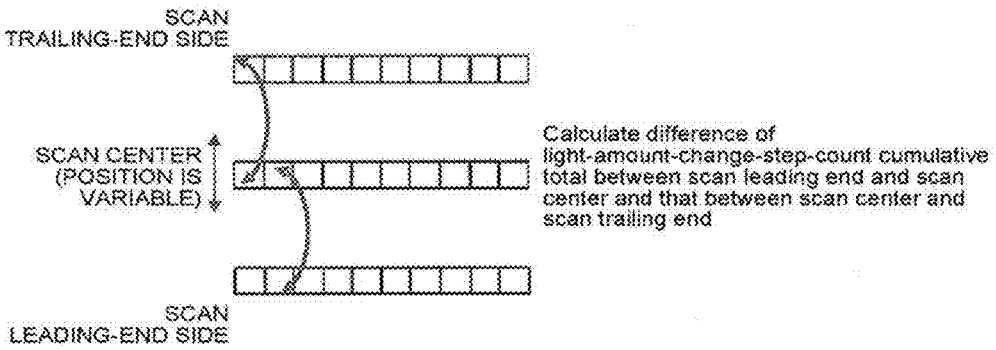
Figure 20:
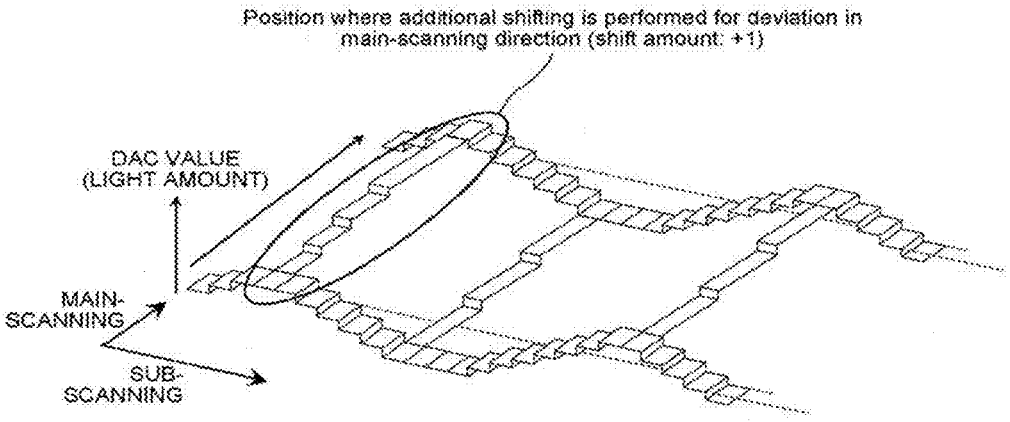
FIG. 20 is a fourth diagram for describing the light-amount-correction-data generation process.

In the embodiment, a main-scanning shading flag is set also when the difference value is superimposed so that the initial DAC value (shading-corrected DAC value) is changed (increased or decreased) when the main-scanning shading flag set (see FIG. 18 and FIG. 19).

Figure 26:
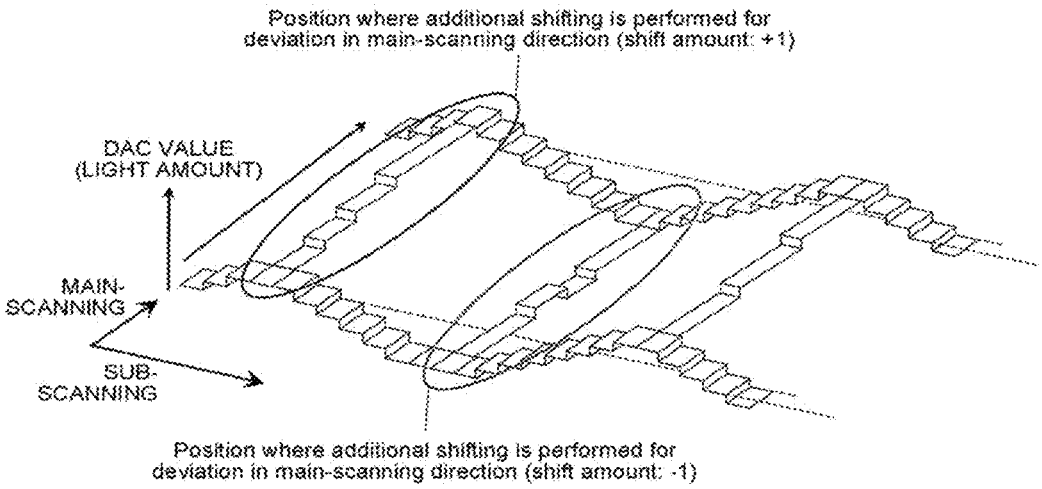
FIG. 26 is a fifth diagram for describing the light-amount-correction-data generation process.

Specifically, at each scan, the main-scanning shading flag is set at a desired point in time between the scan leading end and the scan center. The initial DAC value is increased or decreased by the difference value for the scan between the first and second light-amount correction tables in the direction of its change. As a result, the initial DAC value for after when the shading flag is set is uniformly shifted by the difference value in the direction of its change (see FIG. 19, FIG. 20, and FIG. 26).

Similarly, at each scan, the main-scanning shading flag is set at a desired point in time between the scan center and the scan trailing end. The initial DAC value is increased or decreased by the difference value for the scan between the second and third light-amount correction tables in the direction of its change. As a result, the initial DAC value for after when the shading flag is set is uniformly shifted by the difference value in the direction of its change.

The signal processor 3225 sends, for each scan, the initial DAC value increased or decreased by the difference value(s) for the scan as described above as light-amount correction data to the light source driver 3224.

The light source driver 3224 applies an electric current to the light source 2200 in accordance with the initial DAC value for the scan corrected with the light-amount correction data.

Thus, light amount modulation for reducing two-dimensional density variations containing periodic density variation in the sub-scanning direction and a deviation component in the main-scanning direction can be implemented easily and speedily. Hence, effective reduction in intra-page two-dimensional density nonuniformity can be obtained.

The above-described color printer 2000 (image forming apparatus) of the present embodiment includes the photoconductor drums 2030, the latent-image forming device including and the light sources 2200 and configured to scan the surfaces of the photoconductor drums 2030 with light from the light sources 2200 in the main-scanning direction to thereby form latent images on the surfaces, a developing device configured to develop the latent images into developed images, the density detector 2240 (density detecting device) including, for example, the five optical sensors (OS1 to OS5) configured to detect densities at a plurality of positions (e.g., five positions) in the main-scanning direction on the image developed by the developing device, and the scan control device 3020 (processing device). For each of the image stations, the scan control device 3020 acquires at least two (e.g., three) light-amount correction tables respectively associated with density variations in the sub-scanning direction at at least two (e.g., three) of the plurality of positions in the main-scanning direction on the image, and, for each scan, corrects a DAC value (current reference), which is a set point for setting the amount of light of the light source 2200, on the basis of the difference of corresponding correction data between two, which are respectively associated with two adjacent positions of the at least two (e.g., three) positions, of the at least two light-amount correction tables.

This configuration enables, by acquiring the at least two light-amount correction tables respectively associated with density variations in the sub-scanning direction at the at least two positions in the main-scanning direction on the image, acquiring two-dimensional density-variation information representing density variation in the sub-scanning direction and density deviation in the main-scanning direction. Because the DAC value is corrected on the basis of the deviation in the main-scanning direction between the two light-amount correction tables, two-dimensional density nonuniformity in an output image caused by the density variation in the sub-scanning direction and the density deviation in the main-scanning direction can be reduced.

As a result, computing time and transfer time can be reduced relative to a configuration that reduces two-dimensional density nonuniformity in an image by acquiring two-dimensional correction values of the main-scanning direction and the sub-scanning direction.

Accordingly, the color printer 2000 can reduce two-dimensional density nonuniformity in the sub-scanning direction and in the main-scanning direction in an image with less decrease in productivity.

In arbitrary one scan, the scan control device 3020 may be configured to superimpose a difference value between a cumulative total (correction data) from first scan to the one scan of correction values in one light-amount correction table, which is associated with upstream one in the main-scanning direction of the adjacent two positions, of the light-amount correction tables associated with the adjacent two positions and a cumulative total (correction data) from the first scan to the one scan of correction values in the other light-amount correction table, which is associated with the downstream one in the main-scanning direction of the adjacent two positions, on the DAC value (current reference).

This configuration enables reducing two-dimensional density nonuniformity effectively with less decrease in productivity using a simple technique.

The scan control device 3020 may be configured to superimpose the above-described difference value on the DAC value depending on a direction of change of the cumulative total from the side of the one light-amount correction table to the side of the other light-amount correction table. When configured as such, the scan control device 3020 can adjust the amount of light emitted from the light source 2200 so as to reliably reduce the two-dimensional density nonuniformity.

The scan control device 3020 may be configured to superimpose a main-scanning-direction shading value on the DAC value (set point) when the light-amount correction tables are acquired and, for each scan, superimposes the difference value on the DAC value, on which the shading value is superimposed. With this configuration, because the shading value in the main-scanning direction, which is a parameter for correcting density deviation in the main-scanning direction that comes from the optical system, can be corrected using the difference value, which is a parameter for correcting density deviation in the main-scanning direction that comes from the image formation engine, two-dimensional density nonuniformity can be reduced more reliably.

The plurality of positions may be at least four positions, and the scan control device 3020 may acquire the first and third light-amount correction tables associated with the two positions on both ends of the at least four position and the second light-amount correction table associated with at least one (e.g., one) of two or more positions between the two positions on the both ends. In this case, flexible correction can be made depending on actually-appearing density variation.

The at least one position, associated with which the light-amount correction table is to be acquired, between the two positions on the both ends may be one position. In this case, two-dimensional density nonuniformity can be reduced effectively with the reduced number of the light-amount correction tables to be acquired. Put another way, two-dimensional density nonuniformity can be reduced with a reduced amount of data memory.

The at least one position, associated with which the light-amount correction table is to be acquired, between the two positions on the both ends may be a plurality of positions. In this case, further reduction in two-dimensional density nonuniformity can be obtained by trade-off with some increase in the amount of data memory.

The scan control device 3020 may be configured to select the at least one position, associated with which the light-amount correction table is to be acquired, on the basis of the density variations at the two or more positions. With this configuration, two-dimensional density nonuniformity can be reduced with higher accuracy.

The at least one position, associated with which the light-amount correction table is to be acquired, between the two positions on the both ends may contain a position where amplitude of density variation is largest among the two or more positions. In this case, two-dimensional density nonuniformity can be reduced in a manner to primarily reduce most-noticeable density nonuniformity.

The scan control device 3020 may be configured to acquire the correction values of the light-amount correction tables in the form of a difference relative to a previous scan. With this configuration, the light-amount correction tables can be acquired with further less computing time and less transfer time.

The scan control device 3020 may be configured to acquire the correction values of the light-amount correction tables for every plurality of scans (i.e., on a per plurality of scans basis). With this configuration, the light-amount correction tables can be acquired with further less computing time and less transfer time and, furthermore, the necessary memory capacity can be reduced considerably.

The light source 2200 may include a surface-emitting laser array. In this case, because it is possible to scan the surface of the photoconductor drum 2030 with a plurality of beams at a high density and high speed, productivity can be increased.

An image forming method of the present embodiment includes scanning the surface of the photoconductor drum 2030 with light from the light source 2200 in the main-scanning direction to thereby form a latent image on the surface, developing the latent image into a developed image, detecting densities at a plurality of positions on the image developed at the developing, acquiring at least two light-amount correction tables respectively associated with density variations in the sub-scanning direction at at least two positions of the plurality of positions on the image, and, for each scan, correcting a DAC value (current reference), which is a set point for setting the amount of light of the light source, on the basis of the difference of corresponding correction data between two, which are respectively associated with two adjacent positions of the at least two positions, of the at least two light-amount correction tables.

As a result, computing time and transfer time can be reduced relative to a method of reducing density nonuniformity in the main-scanning direction and density nonuniformity in the sub-scanning direction (two-dimensional density nonuniformity) in an image by acquiring two-dimensional correction values of the main-scanning direction and the sub-scanning direction.

Hence, the image forming method of the present embodiment can reduce two-dimensional density nonuniformity in the sub-scanning direction and in the main-scanning direction in an image with less decrease in productivity.

Setting a light-amount-change step count for every four scans as in the embodiment described above can reduce the necessary memory capacity. However, because the four scans are monotonously increasing or monotonously decreasing, there can be a situation that abrupt density variation in the sub-scanning direction is uncorrectable.

Figure 21:
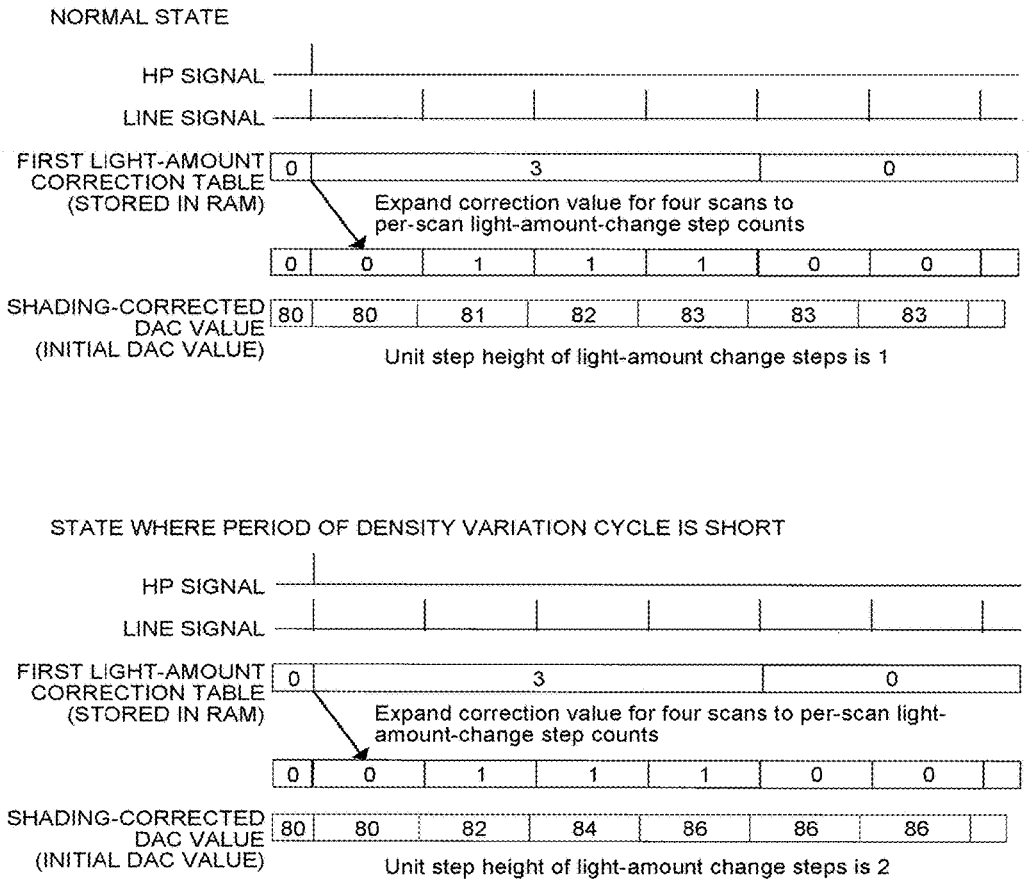
FIG. 21 is a first diagram for describing a light-amount-correction-data generation process of a first modification.
Figure 22:
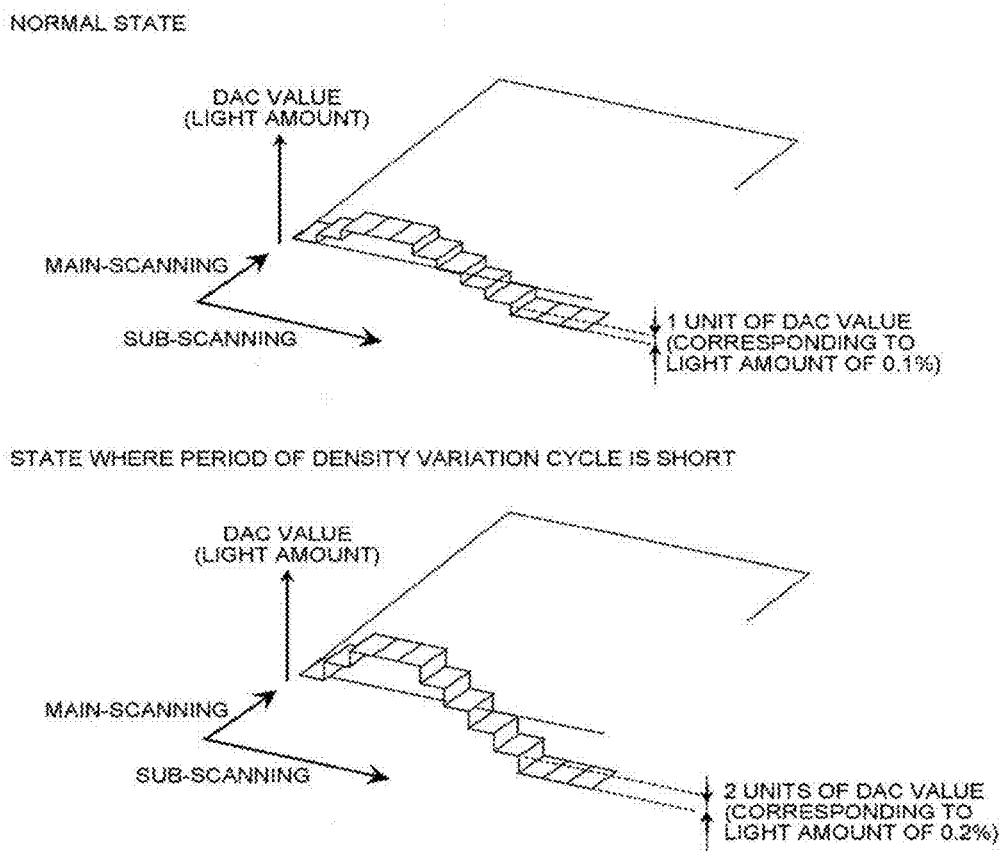
FIG. 22 is a second diagram for describing the light-amount-correction-data generation process of the first modification.

For instance, a configuration that, as in a first modification illustrated in FIG. 21 and FIG. 22, in an unusual state where the period of density variation cycle in the sub-scanning direction is shorter (for example, substantially identical with the period of rotation of the developing roller) than in a normal state (for example, substantially identical with the period of rotation of the photoconductor drum), increases the unit step height (the size of each step of increments and decrements, in which correction using a light-amount correction value is to be made) of the light-amount-change steps (the increments and decrements, in which the correction is to be made) to be higher than in the normal state may be employed. This is because, in such an unusual state, density variation changes sharply.

In the first modification, the unit step height (step size of change in the DAC value) of the light-amount change steps is set to 1, which is the minimum resolution, in the normal state, but set to 2 in the unusual state. For example, a unit step height of 1 may be 0.1% when converted to the amount of light, whereas a unit step height of 2 may be 0.2% when converted to the amount of light.

The first modification is not limited thereto, and may alternatively be configured to, on condition that the unit step height in the unusual state be larger than that in the normal state, set the unit step height in the normal state to 2 or larger and the unit step height in the unusual state to 3 or larger.

By changing the unit step height of the light-amount-change steps in this manner, light-amount correction amounts can be changed uniformly without changing the number of light-amount-change steps. It is also possible to change the light-amount correction amounts by changing the number of light-amount-change steps with the unit step height of the light-amount-change steps maintained unchanged (fixed).

According to the first modification, the scan control device 3020 can adjust the size of each step of increments and decrements, in which the correction using a correction value of the light-amount correction tables is to be made, and, accordingly, can correct a wide variety of density variations in the sub-scanning direction.

Figure 23:
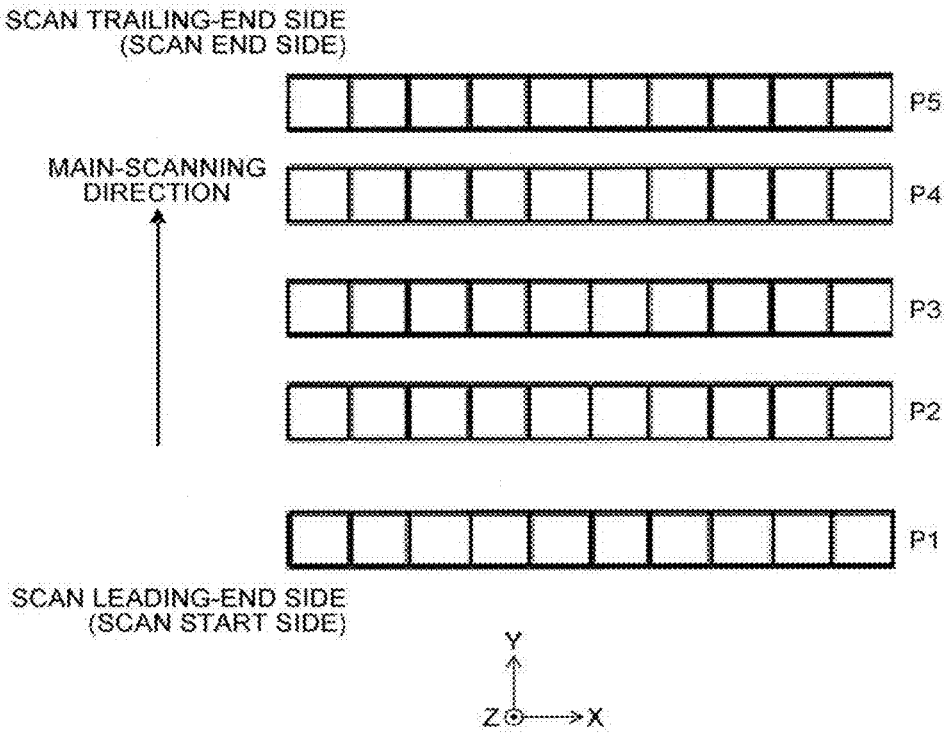
FIG. 23 is a diagram for describing a light-amount-correction-data generation process of a second modification.

A configuration that, as in a second modification illustrated in FIG. 23, acquires five light-amount correction tables respectively associated with the five patterns 1 to 5 may be employed. With this configuration, two-dimensional density nonuniformity can be corrected with higher accuracy by trade-off with some increase in the amount of data memory.

Information for correcting deviation across the main-scanning direction that comes from the image formation engine cannot be obtained from the plurality of light-amount correction tables. For this reason, it is preferable to create and acquire as many light-amount correction tables as possible and acquire density deviation information between as many positions as possible in the main-scanning direction. However, as the number of acquired light-amount correction tables increases, the amount of data memory increases and productivity decreases. Therefore, it is desirable to place importance on achieving a balance between the number of light-amount correction tables and productivity.

Also in the second modification, as in the embodiment described above, for each scan, light-amount correction data is generated on the basis of deviation in the main-scanning direction between two light-amount correction tables that are respectively associated with density variations in the sub-scanning direction of two adjacent patterns, and the light-amount correction data is superimposed on a shading-corrected DAC value (initial DAC value).

In the embodiment described above, the difference value is superimposed on the initial DAC value. Alternatively, the difference value may be superimposed directly on a not-yet-shading-corrected DAC value (set point).

This alternative configuration may preferably be implemented such that, in the light-amount-correction-table acquisition process, a plurality of light-amount correction tables are acquired by not applying the main-scanning-direction shading value to the DAC value (current reference) but, for instance, setting the amount of light of the light source constant in the main-scanning direction (i.e., without performing shading correction in the main-scanning direction). As a result, because two-dimensional-density-variation correction information representing density deviation in the main-scanning direction that comes from the optical system of the optical scanning device 2010 can be obtained from the plurality of light-amount correction tables, it is possible to reduce two-dimensional density nonuniformity.

Hence, in the present embodiment, the main-scanning-direction shading value is not requisite.

Figure 24:
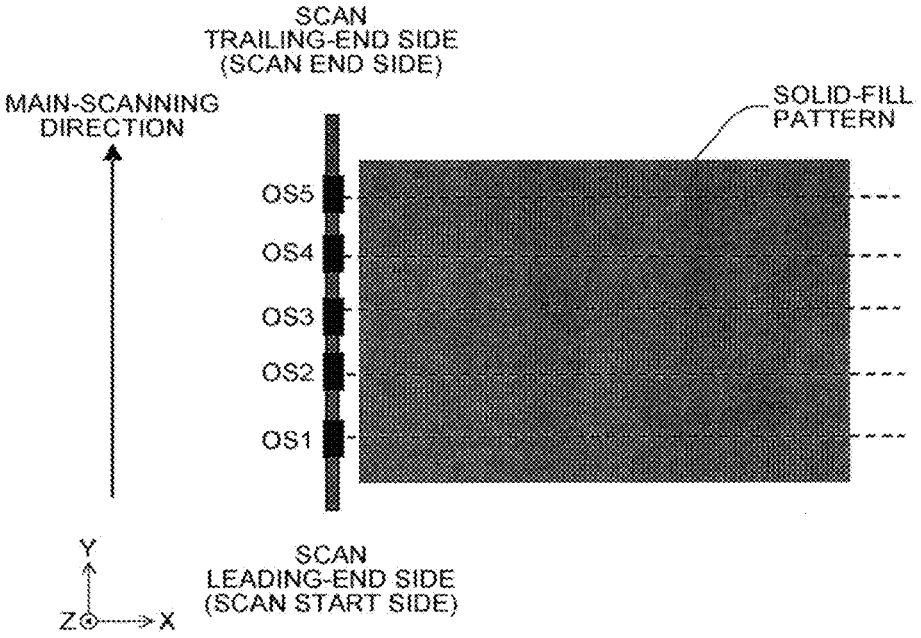
FIG. 24 is a diagram illustrating a density-variation measurement pattern (solid-fill pattern)

In the embodiment and modifications described above, the plurality of (e.g., five) patterns are formed as the density-variation measurement patterns at positions respectively corresponding to the plurality of (e.g., five) optical sensors. However, the pattern to be formed is not limited thereto. It is only required that at least one pattern corresponding to at least two optical sensors of the plurality of optical sensors be formed. For instance, a single solid-fill pattern corresponding to (facing) all the plurality of optical sensors may be formed (see FIG. 24).

For instance, only two patterns respectively corresponding to two optical sensors on the both ends in the main-scanning direction of the plurality of optical sensors may be formed.

It is only required that light-amount correction tables respectively associated with density variations in the sub-scanning direction at at least two main-scanning positions (i.e., positions in the main-scanning direction) of the plurality of main-scanning positions respectively facing the plurality of optical sensors.

In the embodiment and modifications described above, the plurality of (e.g., five) optical sensors are arranged along the Y-axis direction (the main-scanning direction). However, arrangement of the optical sensors is not limited thereto. It is required only that the optical sensors be arranged at a plurality of positions that differ from each other in at least the Y-axis direction (the main-scanning direction). For instance, the optical sensors may be arranged in a direction inclined to the Y-axis direction.

In the present embodiment and modifications described above, the latent image formed on the photoconductor drum 2030 is transferred to recording paper via the transfer belt 2040; however, a method for the transfer is not limited thereto. For instance, a method of directly transferring the latent image formed on the photoconductor drum 2030 onto recording paper may be employed. In this case, light-amount correction tables and light-amount correction data can be generated by forming density-variation measurement patterns on recording paper and detecting and acquiring density variation in the sub-scanning direction in the density-variation measurement patterns using the density detector 2240.

Further alternatively, density variation in a toner image formed (developed) on the surface of the photoconductor drum 2030 may be directly detected using the density detector 2240.

The configuration, number, and arrangement of the optical sensors of the density detector 2240 are not limited to those described in the above-described embodiment and modifications, and can be changed as appropriate. It is only required that the density detector be capable of detecting densities in the sub-scanning direction at a plurality of positions in the main-scanning direction on a toner image.

The RAM 3226 is used as a storage in the above-described embodiment and modifications, the storage is not limited thereto. The storage may alternatively be at least one memory (e.g., a flash memory) other than a RAM, a hard disk drive, or the like.

In the above-described embodiment and modifications, the signal processor 3225 performs the light-amount-correction-table acquisition process and the light-amount-correction-data generation process. Alternatively, at least one of these processes may be performed by, for example, the CPU 3210, the printer control device 2090, or an external processing device connected to the image forming apparatus (e.g., the color printer 2000).

The configuration of the scan control device can be modified as appropriate. For instance, at least a part of processing performed by the drive control unit may alternatively be performed by the image processing unit.

For instance, at least a part of processing performed by the image processing unit may alternatively be performed by the drive control unit.

For instance, at least a part of processing performed by the scan control device 3020 may alternatively be performed by the printer control device 2090. At least a part of processing performed by the printer control device 2090 may alternatively be performed by the scan control device 3020.

In the above-described embodiment, the optical scanning device has an integrated structure. However, the structure of the optical scanning device is not limited thereto. For instance, the optical scanning device may be provided for each of the image forming stations or, further alternatively, the optical scanning device may be provided for each two of the image forming stations.

In the above-described embodiment and modifications, the light source includes surface-emitting lasers; however, the light source is not limited thereto. The light source may include an LED (light-emitting diode), an organic electroluminescent device, an LD (edge-emitting laser), or one of the other lasers, for example.

In the above-described embodiment and modifications, the color printer 2000 includes the four photoconductor drums; however, the number of the photoconductor drums is not limited thereto. For instance, the color printer 2000 may include five or more photoconductor drums.

In the above-described embodiment and modifications, the image forming apparatus is embodied as the color printer 2000. However, the image forming apparatus is not limited thereto. For instance, the image forming apparatus may be a monochrome printer.

Alternatively, for instance, the image forming apparatus may be an image forming apparatus that directly irradiates a medium (e.g., paper) that develops a color when irradiated with laser light with laser light.

The image forming apparatus may be configured to use a silver halide film as the image bearer. In this case, the silver halide film is optically scanned to form a latent image thereon. The latent image can be converted to a visible image through a process similar to a developing process in typical silver halide photography. The visible image can be transferred onto photographic paper through a process similar to a photofinishing process in typical silver halide photography. Such an image forming apparatus can be implemented as an optical prepress apparatus or an optical image-rendering apparatus for rendering CT scan images and the like.

The image forming apparatus can be an image forming apparatus other than a printer, such as a copier machine, a facsimile machine, or a multifunction peripheral into which these machines are integrated, for example.

According to an aspect of the present invention, two-dimensional density nonuniformity in the sub-scanning direction and in the main-scanning direction in an image can be reduced with less decrease in productivity.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus comprising:

a photoconductor drum;

a latent-image forming device including a light source and configured to scan a surface of the photoconductor drum with light from the light source in a main-scanning direction to form a latent image on the surface;

a developing device configured to develop the latent image into a developed image;

a density detecting device configured to detect densities at at least four positions in the main-scanning direction on the developed image;

a memory to store at least four light-amount correction tables respectively associated with the at least four positions, for reducing density variations in a sub-scanning direction at the respective four positions; and processing circuitry configured to acquire, from the memory, at least three light-amount correction tables respectively associated with at least three positions of the at least four positions in the main-scanning direction on the developed image, the at least three light-amount correction tables including a first light-amount correction table, a second light-amount correction table, and a third light-amount correction table, the first light-amount correction table and the third light-amount correction table being associated with two positions on both ends of the at least four positions, the second light-amount correction table being associated with at least one of two or more positions between the two positions on the both ends; and correct, for each scan, a set point for setting an amount of light of the light source based on a difference in corresponding correction data between two light-amount correction tables respectively associated with two adjacent positions of the at least three positions, wherein the processing circuitry selects the second position, associated with which the second light-amount correction table is to be acquired, based on the density variations.

2. The image forming apparatus according to claim 1, wherein, in arbitrary one scan, the processing circuitry superimposes, on the set point, a difference value between a cumulative total from first scan to the one scan of correction values in one light-amount correction table corresponding to upstream one in the main-scanning direction of the adjacent two positions of the light-amount correction tables associated with the adjacent two positions and a cumulative total from first scan to the one scan of correction values in the other light-amount correction table corresponding to downstream one in the main-scanning direction of the adjacent two positions.

3. The image forming apparatus according to claim 2, wherein the processing circuitry superimposes the difference value on the set point depending on a direction of change of the cumulative total from a side of the one light-amount correction table to a side of the other light-amount correction table.

4. The image forming apparatus according to claim 2, wherein the processing circuitry superimposes a main-scanning-direction shading value on the set point when the light-amount correction tables are acquired, and for each scan, superimposes the difference value on the shading value and superimposes the superimposed shading value on the set point.

5. The image forming apparatus according to claim 1, wherein the processing circuitry acquires two, the two being associated with two positions on both ends of the at least four positions, of the light-amount correction tables and at least one, the at least one being associated with at least one of two or more positions between the two positions on the both ends, of the light-amount correction tables.

6. The image forming apparatus according to claim 5, wherein the at least one position is one position.

7. The image forming apparatus according to claim 5, wherein the at least one position is a plurality of positions.

8. The image forming apparatus according to claim 5, wherein the processing circuitry selects the at least one position, associated with which the light-amount correction table is to be acquired, based on the density variations at the two or more positions.

9. The image forming apparatus according to claim 5, wherein the at least one position contains a position where amplitude of density variation is largest among the two or more positions.

10. The image forming apparatus according to claim 1, wherein the processing circuitry acquires correction values of the light-amount correction tables in a form of a difference relative to a previous scan.

11. The image forming apparatus according to claim 1, wherein the processing circuitry acquires the correction values of the light-amount correction tables for every plurality of scans.

12. The image forming apparatus according to claim 1, wherein the processing circuitry is configured to adjust a size of each step of increments and decrements, in which correction using a correction value of the light-amount correction tables is to be made.

13. The image forming apparatus according to claim 1, wherein the light source includes a surface-emitting laser array.

14. The image forming apparatus according to claim 1, wherein the processing circuitry is further configured to:

acquire the light-amount correction tables which are fixed or variable.

15. The image forming apparatus according to claim 1, wherein the first light-amount correction table and the third light-amount correction table are associated with density variation approximated to a first periodic function and the second light-amount correction table is associated with density variation having the largest amplitude among density variations approximated to a second periodic function.

16. The image forming apparatus according to claim 1, wherein the set point for setting an amount of light of the light source is corrected using the at least four light-amount correction tables based on a home position signal and a line signal.

17. An image forming method comprising:

scanning a surface of a photoconductor drum with light from a light source in a main-scanning direction to thereby form a latent image on the surface;

developing the latent image into a developed image;

detecting densities at at least four positions on the developed image;

storing to a memory, at least four light-amount correction tables respectively associated with the at least four positions, for reducing density variations in a sub-scanning direction at the respective four positions;

acquiring, from the memory, at least three light-amount correction tables respectively associated with at least three positions of the at least four positions in the main-scanning direction on the developed image, the at least three light-amount correction tables including a first light-amount correction table, a second light-amount correction table, and a third light-amount correction table, the first light-amount correction table and the third light-amount correction table being associated with two positions on both ends of the at least four positions, the second light-amount correction table being associated with at least one of two or more positions between the two positions on the both ends;

selecting the second position, associated with which the second light-amount correction table is to be acquired, based on the density variations; and correcting, for each scan, a set point for setting an amount of light of the light source based on a difference in corresponding correction data between light-amount correction tables respectively associated with two adjacent positions of the at least three positions.

18. The image forming method according to claim 17, wherein the processing circuitry is further configured to:

acquire the at least three light-amount correction tables which are fixed or variable.

19. The image forming method according to claim 17, wherein one of the at least four light-amount correction tables is associated with density variation approximated to a first periodic function and another one of the at least four light-amount correction tables is associated with density variation having the largest amplitude among density variations approximated to a second periodic function.

20. The image forming method according to claim 17, wherein the set point for setting an amount of light of the light source is corrected using the at least four light-amount correction tables based on a home position signal and a line signal.

* * * * *